US005748207A

United States Patent [19]

Inui et al.

[11] Patent Number: 5,748,207

[45] Date of Patent: May 5, 1998

[54] INK JET RECORDING SYSTEM FOR PREVENTING BLURRING AT COLOR BOUNDARY PORTION

[75] Inventors: Toshiharu Inui; Naoji Otsuka, both of Yokohama; Mamoru Sakaki, Yamato; Jiro Moriyama; Nobuyuki Kuwabara, both of Kawasaki; Isao Ebisawa; Hiroshi Tajika, both of Yokohama; Atsushi Arai; Hisao Yaegashi, both of Kawasaki; Kentaro Yano, Yokohama; Kiichiro Takahashi, Kawasaki; Osamu Iwasaki, Tokyo; Daigoro Kanematsu, Yokohama, all of Japan

[73] Assignee: Canon Kabushiki Kaisha, Tokyo, Japan

[21] Appl. No.: 143,122

[22] Filed: Oct. 29, 1993

[30] Foreign Application Priority Data

| | | | |
|---|---|---|---|
| Oct. 30, 1992 | [JP] | Japan | 4-292640 |
| Oct. 30, 1992 | [JP] | Japan | 4-293009 |
| Oct. 30, 1992 | [JP] | Japan | 4-293017 |
| Oct. 8, 1993 | [JP] | Japan | 5-253050 |

[51] Int. Cl.[6] ..... B41J 2/21; B41J 2/145; B41J 2/15

[52] U.S. Cl. ..... 347/43; 347/40

[58] Field of Search ..... 347/51, 15, 21, 347/43, 100, 19, 42, 40, 22, 9; 358/462

[56] References Cited

U.S. PATENT DOCUMENTS

| | | | |
|---|---|---|---|
| 4,313,124 | 1/1982 | Hara et al. | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,608,577 | 8/1986 | Hori | 346/140 R |
| 4,723,129 | 2/1988 | Endo et al. | 346/1.1 |
| 4,740,796 | 4/1988 | Endo et al. | 346/1.1 |
| 4,864,328 | 9/1989 | Fischbeck | 347/43 |
| 4,908,638 | 3/1990 | Albosta et al. | 347/43 |
| 5,059,989 | 10/1991 | Eldridge et al. | 347/43 |
| 5,079,571 | 1/1992 | Eriksen | 347/40 |
| 5,220,342 | 6/1993 | Moriyama | 346/1.1 |
| 5,252,992 | 10/1993 | Fukushima et al. | 347/22 |
| 5,440,329 | 8/1995 | Meggitt et al. | 347/43 |
| 5,477,246 | 12/1995 | Hirabayashi et al. | 347/12 |

FOREIGN PATENT DOCUMENTS

| | | |
|---|---|---|
| 0401575 | 12/1990 | European Pat. Off. . |
| 0433556 | 6/1991 | European Pat. Off. . |
| 54-056847 | 5/1979 | Japan . |
| 59-123670 | 7/1984 | Japan . |
| 59-138461 | 8/1984 | Japan . |
| 60-071260 | 4/1985 | Japan . |
| 1114447 | 5/1989 | Japan . |
| 3132256 | 6/1991 | Japan . |
| 3146355 | 6/1991 | Japan . |
| 4158049 | 6/1992 | Japan . |

*Primary Examiner*—Benjamin R. Fuller
*Assistant Examiner*—Thinh Nguyen
*Attorney, Agent, or Firm*—Fitzpatrick, Cella, Harper & Scinto

[57] ABSTRACT

A recording head having an ejection portion group for ejecting a black ink, and ejection portion groups for ejecting color inks is used. When a black image to be printed by the black ink is present adjacent to a color image to be printed by the color ink, a black image portion adjacent to the color image and a black image portion which is not adjacent to the color image are formed in different scans, thereby obtaining a high-quality image from which ink blurring at a boundary portion between the black and color images is eliminated.

50 Claims, 31 Drawing Sheets

FIG. 27B FIG. 27D
FIG. 27A FIG. 27C
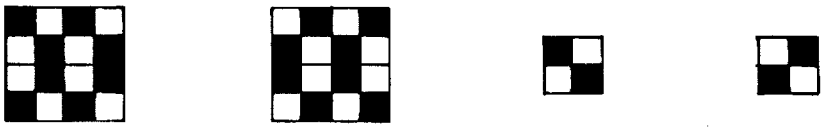
FIG. 28B FIG. 28D
FIG. 28A FIG. 28C
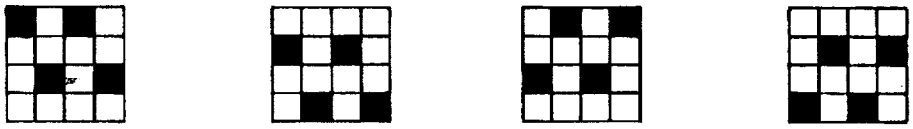
FIG. 29
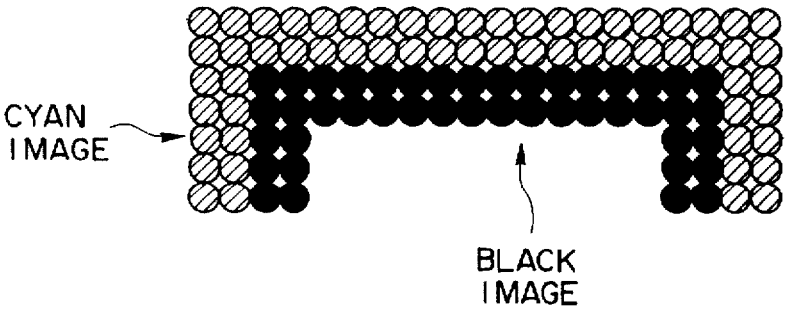

INK JET RECORDING SYSTEM FOR PREVENTING BLURRING AT COLOR BOUNDARY PORTION

BACKGROUND OF THE INVENTION

1. Field of the Invention

The present invention relates to an ink jet recording method for recording a multi-color image using a plurality of color inks and a recording head having a plurality of nozzles corresponding to the colors, and an ink jet recording head used in the ink jet recording method. More particularly, the present invention relates to an ink jet recording method and an ink jet recording head suitable for recording a boundary portion between a black image and a color image.

The present invention can be applied to all apparatuses using recording media such as paper, a cloth, a non-woven fabric, an OHP sheet, and the like, and the apparatuses to which the present invention is applied include a printer, a copying machine, a facsimile apparatus, and the like.

2. Related Background Art

Conventionally, a method of obtaining a color image using four color inks, i.e., yellow (Y), magenta (M), cyan (C), and black (Bk) is widely known, and is applied to a printer, a copying machine, and the like.

In a conventional ink jet recording method, in order to obtain a highly color-developed color image free from ink blurring, a special-purpose paper sheet having an ink absorbing layer must be used. However, in recent years, a method with printing adaptability to "normal paper sheets", which are used in large amounts in a printer, a copying machine, and the like, due to improvement of inks has been put into practical applications. However, printing quality on "normal paper sheets" does not have a satisfactory level yet. The most serious cause of such low printing quality is a conflict between 1̂ blurring of different color inks and 2̂ black recording quality (in particular, black character recording quality).

Normally, when a color image is obtained on a normal paper sheet by the ink jet recording method, quick-drying inks which have a high penetration speed to normal paper sheets are used. For this reason, a high-quality image, which is free from blurring of different color inks, can be obtained. However, the entire image has a low density, and so-called feathering in which the inks slightly blur along fibers of paper tends to occur around recorded image areas of the respective colors.

Feathering is not relatively conspicuous in a color image area, but is conspicuous in a black image area, thus deteriorating recording quality. In particular, when a black image is a character, an unclear character having no sharpness is formed, and its quality is poor.

In order to achieve high-quality black color recording which is free from feathering and has a high density, a black ink having a relatively low penetration speed to a normal paper sheet must be used. However, in this case, different color inks blur at a boundary portion between adjacent recorded image areas of black and another color, thus considerably deteriorating image quality.

In this manner, improvement of color recording quality by achieving both prevention of blurring of different color inks, e.g., a black ink and another color ink, and elimination of feathering of, especially, black poses conflicting problems.

These problems are associated with the volume of an ink droplet to be ejected, the ink absorption amount of a recording medium, which absorbs the ink, and a process from when the ink becomes attached to the recording medium until it penetrates into the medium, and depend on the ink and the recording medium. When the recording medium has a layer which easily absorbs an ink, serious problems are not posed. However, the above-mentioned problems are posed when paper sheets used in a large quantity in a normal copying apparatus, or OHP sheets or cloth are used as the recording medium.

Japanese Laid-Open Patent Application No. 3-146355 proposes a method in which no image is recorded on an area along the boundary between black and another color. However, with this method, data to be recorded may change.

Also, Japanese Laid-Open Patent Application No. 4-158049 proposes a method in which a plurality of color heads for color recording, and a character recording head are arranged, and the plurality of color heads and the character recording heads are selectively used in correspondence with an image to be recorded. However, with this method, an apparatus must have the character recording head in addition to the plurality of color heads for conventional color recording, resulting in increases in cost and in apparatus scale.

Furthermore, although a system using four parallel recording heads is suitable for high-speed processing, ink blurring among colors easily occurs when a print operation is performed on a recording sheet such as a normal sheet having a low fixing speed of the inks, thus considerably deteriorating image quality.

Thus, a recording head, in which nozzle (ejection orifice) groups, corresponding to colors, for ejecting yellow, magenta, cyan, and black inks are arranged not to overlap each other in the scan direction, as shown in FIG. 1, has been proposed. When this recording head is used, the number of recording heads for obtaining a multi-color image can be one. Therefore, this recording head is suitable for a low-cost, compact apparatus. Although a time required for printing is longer than that of the system using the four recording heads, ink blurring does not easily occur, and high image quality can be expected.

However, even when the recording head, in which the nozzle groups corresponding to the colors are arranged not to overlap each other, as shown in FIG. 1, is used, ink blurring among the colors cannot always be completely prevented. Also, a color printer, a color copying machine, and the like are required to have high quality of a black image as in a conventional monochrome apparatus. In order to satisfy this requirement, it is attempted to set the ejection amount of a black ink to be larger than the ejection amount of other color inks. However, in this case, ink blurring at a boundary portion between a black image and a color image becomes conspicuous, and print quality becomes very low.

SUMMARY OF THE INVENTION

The present invention has been made to solve the conventional problems, and has as its object to provide an ink jet recording method capable of obtaining a high-quality image from which ink blurring at a boundary portion between a black image and a color image is eliminated.

It is another object of the present invention to provide a color ink jet recording method which can obtain a black image having a high density and free from feathering even in an image including both black and color image portions, and can obtain a high-quality image free from ink blurring between different color images or between a black image and a color image.

It is still another object of the present invention to provide an ink jet recording apparatus and an ink jet recording method, which can prevent a recording error due to interference of neighboring different color inks, and a decrease in resolution generated at boundaries between different color ink dots without losing data of characters or images to be recorded.

In order to achieve the above objects, according to the present invention, there is provided an ink jet recording method for obtaining a multi-color image by scanning, on a recording paper sheet, a recording head which has an ejection portion group including m ejection portions for ejecting a black ink and ejection portion groups each including n ($2n \leqq m$) ejection portions for ejecting a color ink in correspondence with a plurality of colors, and is arranged so that the groups of ejection portions for ejecting the black and color inks do not overlap in a scan direction, comprising the steps of:

discriminating whether or not a black image to be printed using the black ink and a color image to be printed using the color inks are present adjacent to each other; and executing a scan for forming a black image portion adjacent to the color image independently of a scan for forming a black image portion which is not adjacent to the color image when it is determined that the black and color images are present adjacent to each other.

Also, an ink jet recording head adopted in an ink jet recording method of the present invention has a plurality of nozzles which can eject inks by forming bubbles upon reception of heat energy, the nozzles constitute a nozzle group including m nozzles for ejecting a black ink, and nozzle groups each including n ($2n \leqq m$) nozzles for ejecting a color ink in correspondence with a plurality of colors, the recording head is arranged, so that the nozzle groups for ejecting the black and color inks do not overlap each other, the m nozzles for ejecting the black ink are divided into a first nozzle group including first to i-th nozzles, and a second nozzle group including (i+1)-th to j-th ($1<i<j \leqq m$) nozzles, and different amounts of heat energy can be supplied to the first and second nozzle groups.

According to the present invention, when a black image and a color image are present adjacent to each other, a black image portion adjacent to a color image portion and a non-adjacent black image portion are printed in different scans. Therefore, since a time required from when the color image portion is printed until the black image portion adjacent to the color image portion is printed can be prolonged, ink blurring does not occur even when the black image portion and the color image portion are formed adjacent to each other. Since different amounts of heat energy are applied corresponding to the black image portion adjacent to the color image portion and the non-adjacent black image portion, an image in which ink blurring is further suppressed can be obtained.

According to the present invention, there is also provided an ink jet recording method for forming a multi-color image by scanning, relative to a recording medium, a recording head, which has an ejection portion group for ejecting a black ink, and a plurality of ejection portion groups for ejecting a plurality of different color inks, comprising the steps of:

discriminating whether or not a black image to be formed by the black ink is present adjacent to a color image to be formed by the color ink; and changing image formation processing at an adjacent boundary portion between the black ink and the color ink to be different from image formation processing at a non-adjacent boundary portion when it is determined that the black image is present adjacent to the color image.

According to the present invention, since image forming processing at a boundary portion between the black ink and another color ink is different from that executed for a non-adjacent boundary portion, a high-quality image free from ink blurring between different color images or between a black image and a color image can be obtained.

According to the present invention, there is also provided an ink jet recording method for obtaining a multi-color image by scanning, on a recording paper sheet, a recording head which has an ejection portion group including m ejection portions for ejecting a black ink and ejection portion groups each including n ($2n \leqq m$) ejection portions for ejecting a color ink in correspondence with one of a plurality of colors, and is arranged so that the groups of ejection portions for ejecting the black and color inks do not overlap in a scan direction, comprising the steps of:

discriminating whether or not a black image is present adjacent to a color image to be formed by the ejection portion group for ejecting the color ink, which group is arranged adjacent to the ejection portion group for ejecting the black ink; and divisionally printing the image to be formed by the ejection portion group for ejecting the color ink, which group is arranged adjacent to the ejection portion group for ejecting the black ink in a plurality of scans, when it is determined that the black image is present adjacent to the color image to be formed by the ejection portion group for ejecting the color ink, which group is arranged adjacent to the ejection portion group for ejecting the black ink.

According to the present invention, when a color image is formed by the color ink ejection nozzle group adjacent to the black ink ejection nozzle group at a position adjacent to a black image, since the image to be formed by the color ink ejection nozzle group adjacent to the black ink ejection nozzle group is divisionally printed in forward and backward scans of the recording head, ink blurring at the boundary with the black image portion does not easily occur.

According to the present invention, there is provided an ink jet recording apparatus, which has a plurality of color inks, and an ink jet recording head having a large number of ejection orifices corresponding to the plurality of inks, and records an image on a recording medium by ejecting the plurality of color inks on the basis of image information, wherein record pixels located in a predetermined area along a color boundary defined by a color difference in units of record pixels of the image are recorded using a smaller ejection amount of the inks for forming the record pixels than a portion which is not the color boundary. Thus, a recording error or a decrease in resolution at the boundary portion can be prevented.

BRIEF DESCRIPTION OF THE DRAWINGS

FIGS. 27A to 27D are views for explaining patterns used for executing a print operation in two scans;

FIGS. 28A to 28D are views for explaining patterns used for executing a print operation in four scans;

FIG. 29 is a view for explaining an area where the ejection amount is to be decreased;

DESCRIPTION OF THE PREFERRED EMBODIMENTS

The preferred embodiments of the present invention will be described in detail hereinafter.

(First Embodiment)

Figure 1:
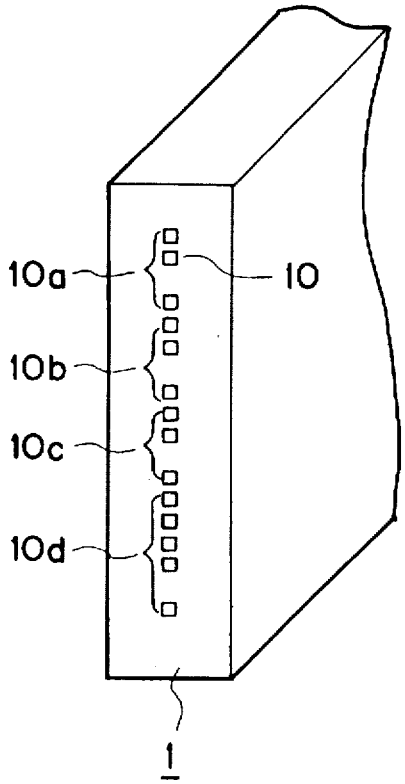
FIG. 1 is a schematic perspective view for explaining a recording head used in the first embodiment.

FIG. 1 is a schematic perspective view showing a recording head used in an ink jet recording method of the present invention. A recording head 1 has nozzle groups 10, i.e., a nozzle group 10*a* for ejecting a yellow ink, a nozzle group 10*b* for ejecting a magenta ink, a nozzle group 10*c* for ejecting a cyan ink, and a nozzle group 10*d* for ejecting a black ink. The nozzle groups corresponding to the colors are arranged not to overlap each other in the scan direction. In each of the nozzle groups 10*a*, 10*b*, and 10*c*, 24 nozzles are arranged at a density of 360 nozzles per inch (360 dpi), and in the nozzle group 10*d*, 48 nozzles are arranged at 360 dpi. The ejection amount of the nozzle group 10*d* is about 80 ng, and the ejection amount of each of the nozzle groups 10*a*, 10*b*, and 10*c* is about 40 ng.

Print methods executed when various images are printed using the recording head shown in FIG. 1 will be described below.

Figure 2:
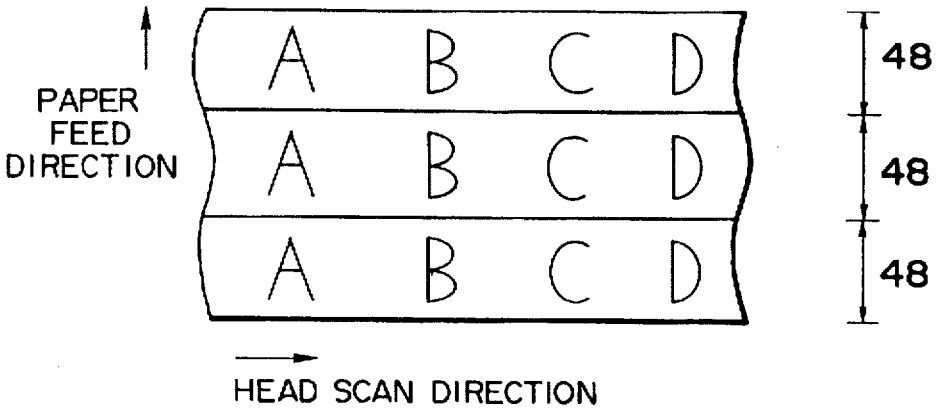
FIG. 2 is a view for explaining a process for printing only a black image.
Figure 12B:
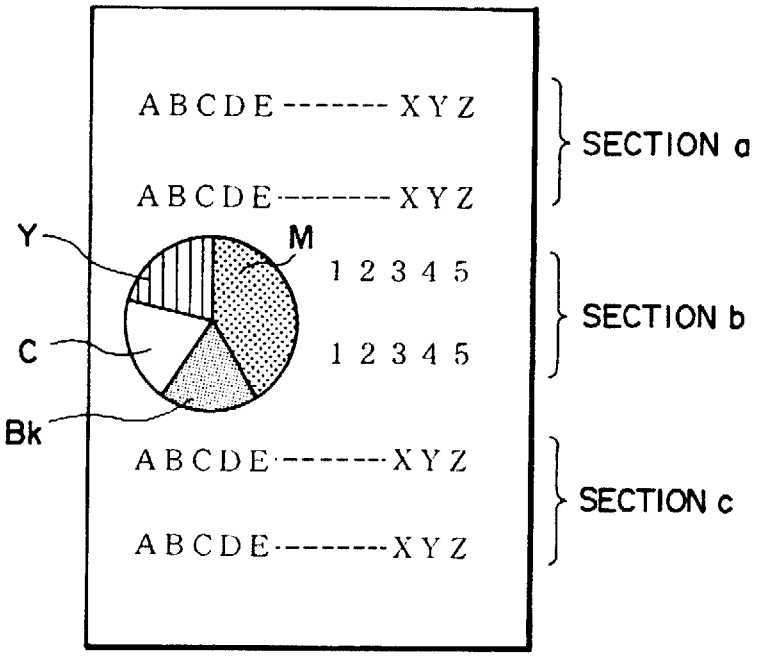
FIGS. 12A and 12B are views for explaining the types of images and a feed operation of a recording paper sheet.
Figure 12A:
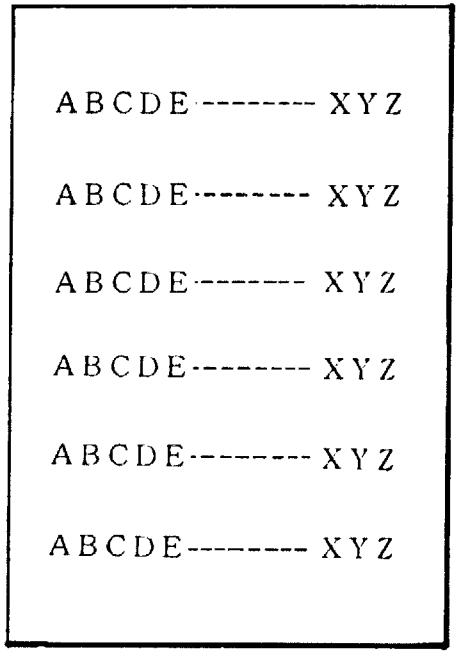

FIG. 2 is a view for explaining a case wherein only a black image is printed using the black ink ejection nozzle group 10*d*. In this case, all the 48 nozzles of the nozzle group 10*d* are used, and upon completion of the scan of the recording head, a recording paper sheet is fed by a 48-nozzle pitch to print the next line. This method is particularly effective for a case wherein all characters are black, and images in one page are also black, as shown in FIG. 12A, or for printing black image portions (sections a and c in FIG. 12B) when a black image and a color image are separated in the feed direction of the recording sheet, even when both a black image and a color image are present in one page (all characters are black), as shown in FIG. 12B. This method has an advantage of a high recording speed. When a recording head of this type is used, the feed pitch of the recording paper sheet for a portion where a color image is present (a section b in FIG. 12B) basically corresponds to 24 nozzles.

Figure 3A:
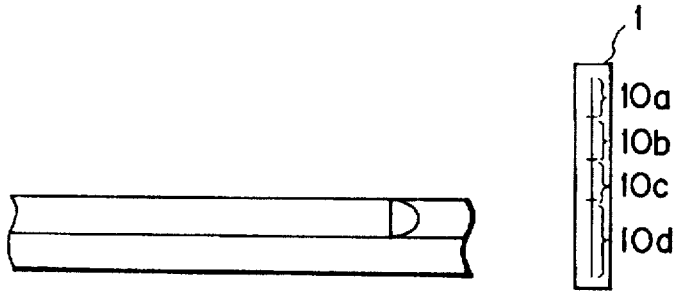
FIGS. 3A to 3F are views for explaining a process for printing an image including both black and color image portions.
Figure 3B:
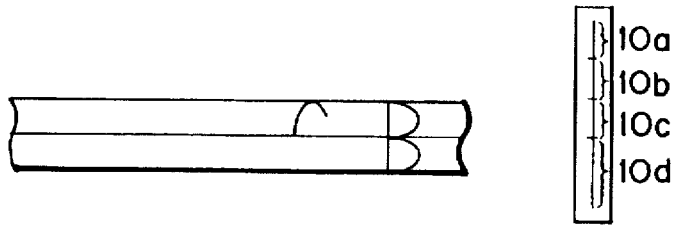
Figure 3C:
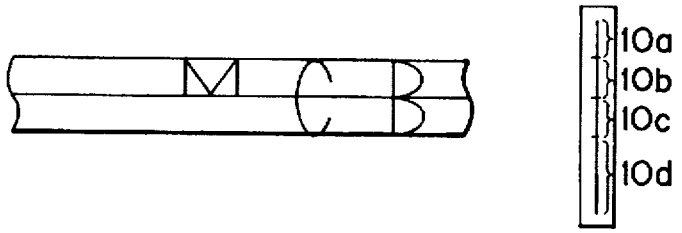
Figure 3D:
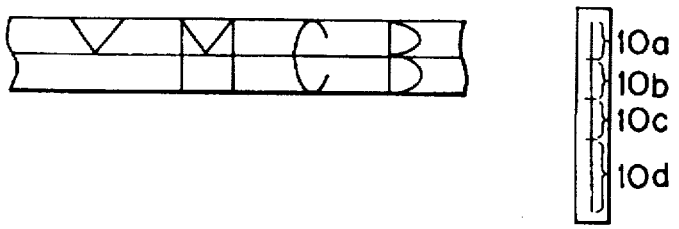
Figure 3E:
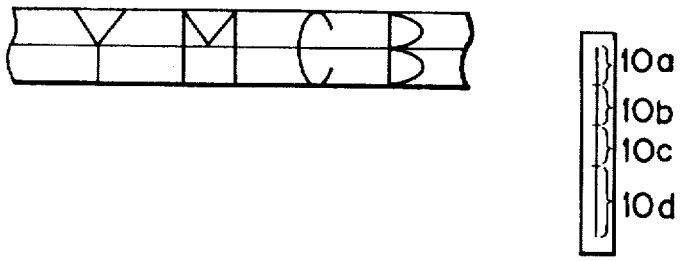
Figure 3F:
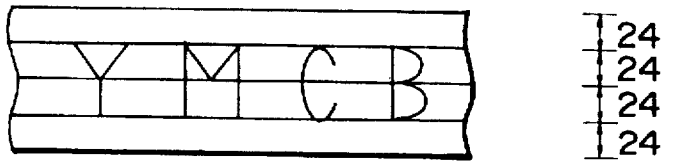

FIGS. 3A to 3F show a case wherein a color image is printed using the color ink ejection nozzle groups 10*a*, 10*b*, and 10*c*, and the black ink ejection nozzle group 10*d*. In this case, 24 nozzles are used for each color (FIG. 3F). In FIGS. 3A to 3F, as nozzles for ejecting the black ink, nozzles near the cyan ink ejection nozzle group 10*c* are used. In FIGS. 3A to 3F, Y represents an image printed using the yellow ink, M represents an image printed using the magenta ink, C represents an image printed using the cyan ink, and Bk represents an image printed using the black ink.

A process for forming a color image will be described below with reference to FIGS. 3A to 3F. FIG. 3A shows a state wherein the recording head 1 is scanned at the illustrated position to print the upper half portion, corresponding to 24 nozzles, of a black character "B". Subsequently, a recording paper sheet is fed by a 24-nozzle pitch, and the remaining lower half portion of the black character "B" and the upper half portion, corresponding to 24 nozzles, of a cyan character "C" are printed from the state shown in FIG. 3B. Furthermore, the recording paper sheet is fed by another 24-nozzle pitch. As shown in FIG. 3C, the lower half portion, corresponding to 24 nozzels, of the cyan character "C" is printed, and the upper half portion, corresponding to 24 nozzels, of a magenta character "M" is printed. The above-mentioned operations are performed, as shown in FIGS. 3D and 3E, thus completing the print operations for four colors.

Since the images shown in FIG. 3F are not adjacent to each other, a decrease in print quality caused by color blurring does not particularly occur. However, in the case of images shown in FIG. 4, since black characters "B" are respectively present in yellow, magenta, and cyan backgrounds, color blurring easily occurs at a boundary portion between the black character and the color background. In particular, it is preferable in terms of print quality of a black image to design the ejection amount per dot of the black ink to be larger than that of each color ink. In this case, color blurring more easily occurs at the boundary between a black image and a color image.

Figure 5A:
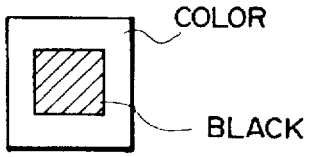
FIGS. 5A to 5G are views for explaining a process for printing an adjacent portion between a black image portion and a color image portion.
Figure 5B:
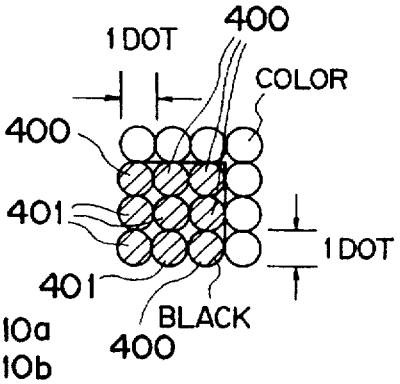

The first embodiment of the present invention for solving this problem will be described below with reference to FIGS. 5A to 5G. FIG. 5A shows an image in which a color image is present as a background portion of a black image. FIG. 5B is a partially enlarged view of FIG. 5A. In FIG. 5B, an image (dot) 400 is present adjacent to a color image, and an image (dot) 401 is not adjacent to the color image. According to the present invention, the dots 400 adjacent to the color image, and the non-adjacent dots 401 are printed in different scans, and different amounts of heat energy are applied to the dots 400 and 401. This control will be described below with reference to FIGS. 5C to 5G. Note that the recording head shown in FIG. 1 is used, and the color image as the background portion is a cyan image.

Figure 5C:
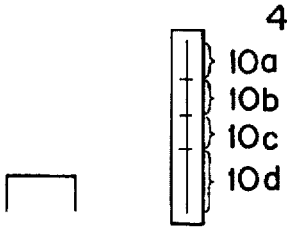

Referring to FIG. 5C, the upper half ones of adjacent dots between the black image portion and the color image portion are printed using the 25th to 48th nozzles (24 nozzels) of the black ink ejection nozzle group 10*d*.

Figure 5D:
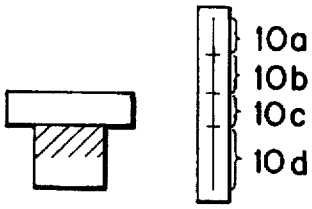

After a recording paper sheet is fed by a 24-nozzel pitch, the lower half ones of the adjacent (boundary) dots between the black image portion and the cyan image portion are printed using the 25th to 48th nozzles of the black ink ejection nozzle group 10*d*, and at the same time, the upper half ones of dots which are not adjacent to the cyan image portion are printed using the 1th to 24th nozzles of the black ink ejection nozzle group 10*d*, as shown in FIG. 5D. At this time, a portion of the cyan background portion is printed using the cyan ink ejection nozzle group 10*c*.

Figure 5E:
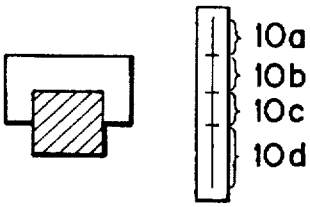
Figure 5F:
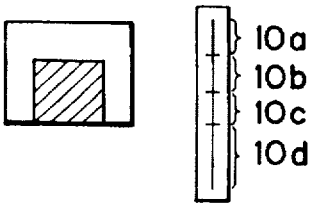
Figure 5G:
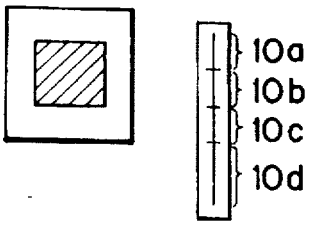

After the recording paper sheet is fed by another 24-nozzel pitch, as shown in FIG. 5E, the lower half ones of the dots which are not adjacent to the cyan image portion are printed using the 1th to 24th nozzles of the black ink ejection nozzle group 10*d*, and another portion of the cyan image portion is printed using the cyan ink ejection nozzle group 10*c*. Thereafter, the remaining cyan image portion is printed, as shown in FIGS. 5F and 5G.

When print operations are performed in the above-mentioned procedure, an adjacent portion and a non-adjacent portion present within a range of each 24-nozzel feed pitch of a recording paper sheet are not printed at the same time, and are printed in different scans using different nozzles in the black ink ejection nozzle group. Therefore, a high-quality image free from ink blurring can be obtained without prolonging a print time.

Figure 4:
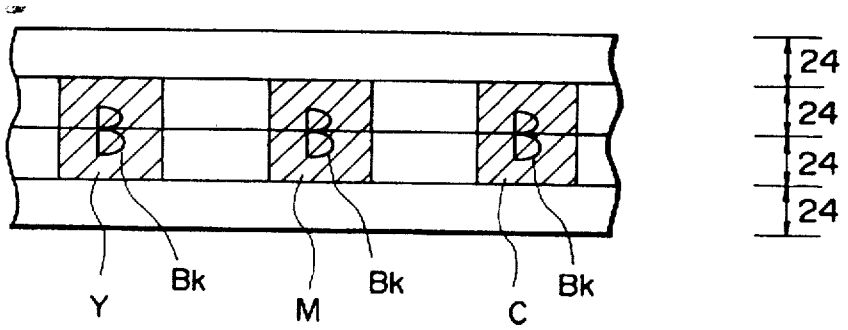
FIG. 4 is a view for explaining an image in which a black image portion is formed adjacent to a color image portion.

When the image shown in FIG. 4 was printed at an ink ejection frequency of 5 kHz under the above-mentioned conditions, a high-quality image free from ink blurring at a boundary portion between the black image portion and the color image portion was obtained.

(Second Embodiment)

Figure 10:
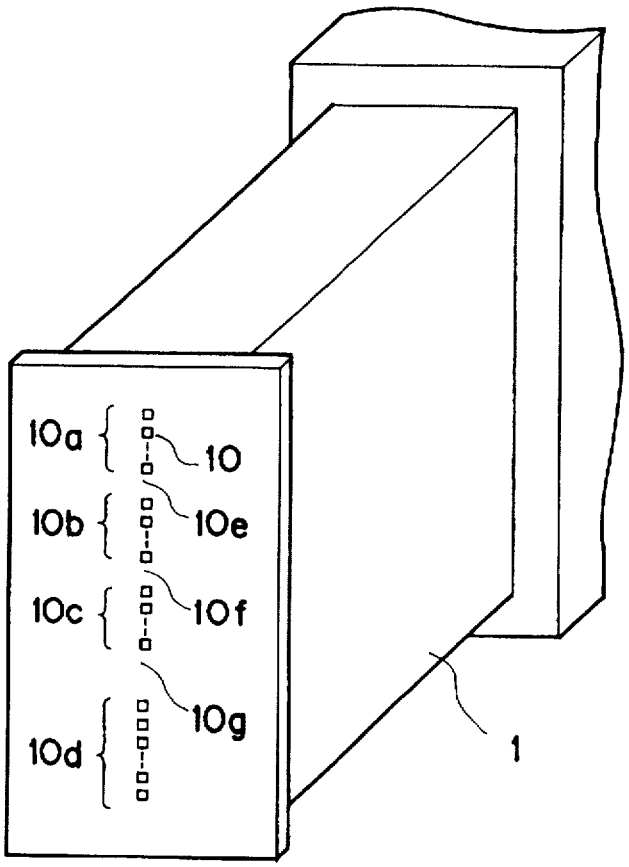
FIG. 10 is a schematic perspective view for explaining the recording head used in the second embodiment.

A recording head shown in FIG. 10 is constituted by a yellow ink ejection nozzle group 10*a*, a magenta ink ejection nozzle group 10*b*, a cyan ink ejection nozzle group 10*c*, and a black ink ejection nozzle group 10*d*, as in the first embodiment. In this embodiment, the black ink ejection nozzle group has 64 nozzles, and each of the color ink ejection nozzle groups has 24 nozzles. Spaces 10*e* and 10*f* for eight nozzles are respectively assigned between the yellow and magenta ink ejection nozzle groups 10*a* and 10*b*, and between the magenta and cyan ink ejection nozzle groups 10*b* and 10*c*, and a space 10*g* for 16 nozzles is assigned between the cyan and black ink ejection nozzle groups 10*c* and 10*d*. The ejection amounts of these nozzles are the same as those in the first embodiment.

Since this recording head has the above-mentioned spaces, ink chambers for supplying the inks to the nozzles of the corresponding colors can be easily formed. Furthermore, a temperature sensor for the recording head can be arranged in the space, and the effect of the present invention can be easily obtained by applying the present invention.

Figure 7:
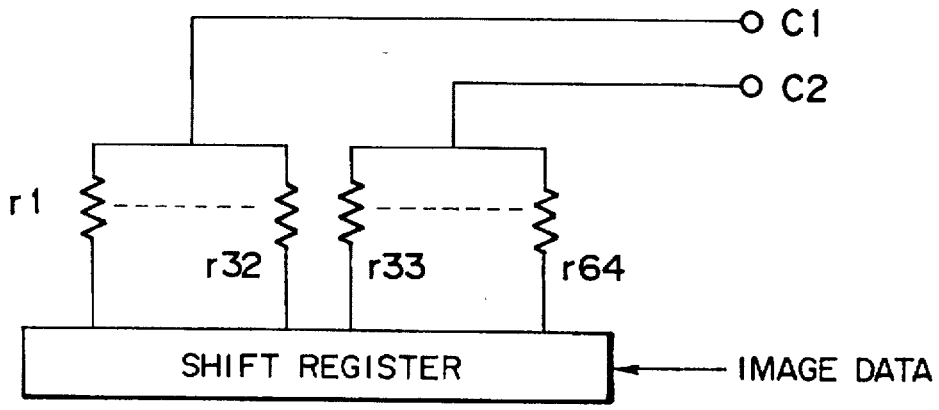
FIG. 7 is a circuit diagram for explaining a recording head used in the second embodiment.

Moreover, this recording head separately has a terminal for applying heat energy to the 1th to 32nd nozzles of the black ink ejection nozzle group 10*d*, and a terminal for applying heat energy to the 33rd to 64th nozzles thereof. More specifically, as shown in FIG. 7, the recording head has heaters r1 to r64 respectively provided to the 1st to 64th nozzles, a terminal C1 connected to be able to drive the heaters r1 to r32, and a terminal C2 connected to be able to drive the heaters r33 to r64. Therefore, heat energy E1 applied upon printing an adjacent portion in the first embodiment can be applied from the terminal C2, and heat energy E2 applied upon printing a non-adjacent portion can be applied from the terminal C1.

Figure 8:
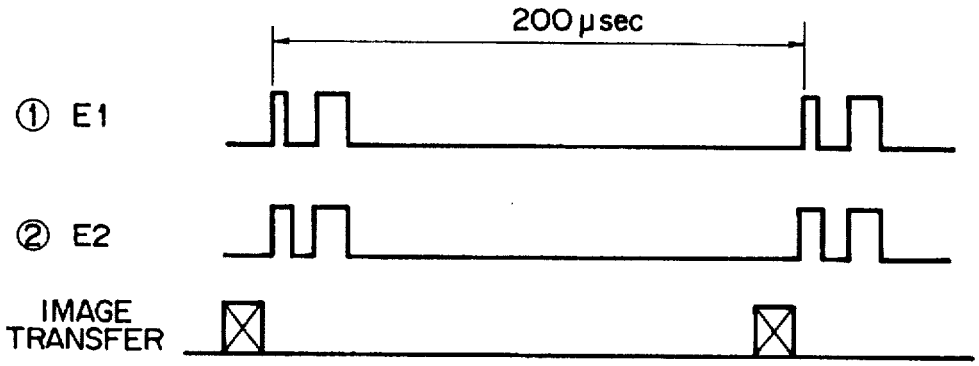
FIG. 8 is a chart for explaining heat energy to be applied to the recording head used in the second embodiment.

FIG. 8 is a chart showing the image transfer timing to the recording head, and the timings of pulses to be applied to the terminals C1 and C2.

Referring to FIG. 8, a waveform $\hat{1}$ represents the heat energy (pulse width) E1 which is applied to print dots adjacent to a color image. With these pulses, the heaters are energized for 1 μsec, and are further energized for 3 μsec after an elapse of a 3-μsec rest time. A waveform $\hat{2}$ represents the heat energy E2 for printing non-adjacent dots. With these pulses, the heaters are energized for 2 μsec, and are further energized for 3 μsec after an elapse of a 2-μsec rest time. The waveform $\hat{2}$ defines a condition for obtaining a pulse width used upon printing a normal image, and can provide an ejection amount of about 80 ng. The waveform $\hat{1}$ defines a condition for obtaining a pulse width used upon printing dots adjacent to a color image, and can provide an ejection amount of about 73 ng.

Figure 11:
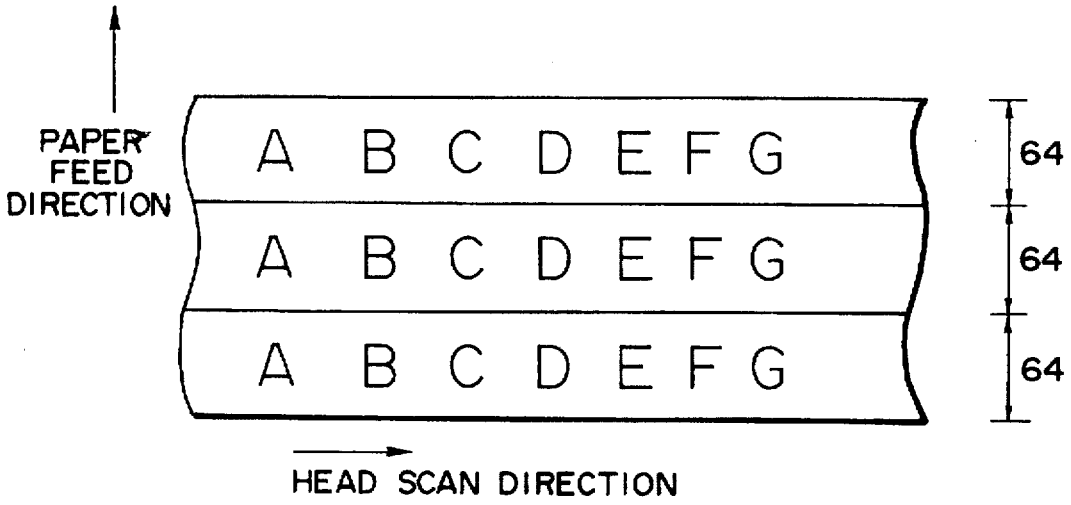
FIG. 11 is a view for explaining a process for printing only a black image.

FIG. 11 shows a recording method executed when only a black image for one page is printed using the recording head of this embodiment or when a black image portion is printed using the recording head of this embodiment in a case wherein even when an image for one page includes both black and color image portions, the black and color image portions are separated in the feed direction of a recording paper sheet. More specifically, a black image is printed using all the 64 nozzles, and the feed pitch of a recording paper sheet corresponds to 64 nozzles.

A recording method executed when the image shown in FIG. 4 is printed using the recording head of this embodiment will be described below with reference to FIGS. 9A to 9H. In this embodiment, when a black image is printed, the 9th to 56th nozzles (48 nozzles) of the black ink ejection nozzle group 10*d* are used. Of these nozzles, black dots in an adjacent portion between a color image and a black image are printed using the 33rd to 56th nozzles (24 nozzels), and black dots in a non-adjacent portion are printed using the 9th to 32nd nozzles (24 nozzels).

Figure 9A:
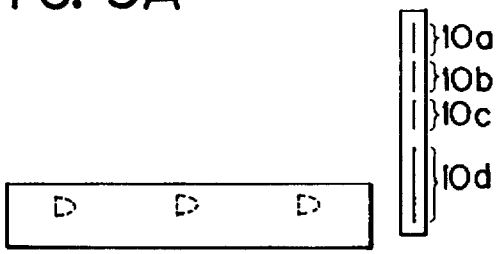
FIGS. 9A to 9H are views for explaining a process for printing an image shown in FIG. 4 in the second embodiment.
Figure 9B:
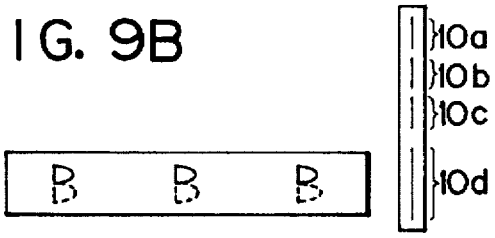

First, as shown in FIG. 9A, black dots adjacent to the color image of the upper half portion of each black character "B" are printed using the 33rd to 56th nozzles under the condition $\hat{1}$. A recording paper sheet is fed by a 24-nozzel pitch, black dots adjacent to the color image of the lower half portion of each black character "B" are printed using the 33rd to 56th nozzles under the condition $\hat{1}$, and at the same time, non-adjacent dots of the upper half portion of the black character "B" are printed using the 9th to 32nd nozzles under the condition $\hat{2}$, as shown in FIG. 9B. At this time, no color dots are printed.

Figure 9C:
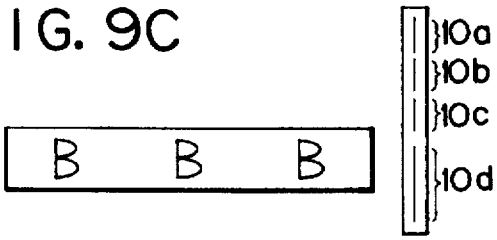

After the recording paper sheet is fed, as shown in FIG. 9C, non-adjacent dots of the lower half portion of each black character "B" are printed using the 9th to 32nd nozzles of the black ink ejection nozzle group 10*d* under the condition $\hat{2}$. At this time, no color dots are printed, either.

Figure 9D:
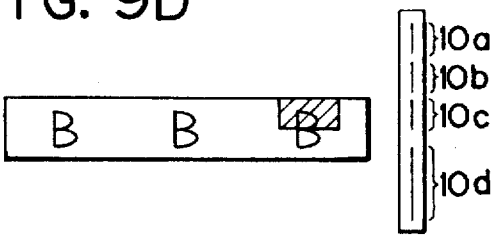
Figure 9E:
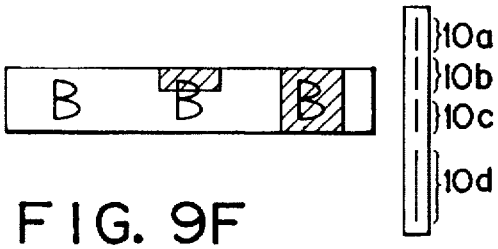

After the recording paper sheet is fed, as shown in FIG. 9D, a portion of a cyan background portion is printed using the cyan ink ejection nozzle group 10*c*. After the recording paper sheet is fed, as shown in FIG. 9E, the remaining portion of the cyan background portion is printed, and a portion of a magenta background portion is printed using the magenta ink ejection nozzle group 10*b*.

Figure 9F:
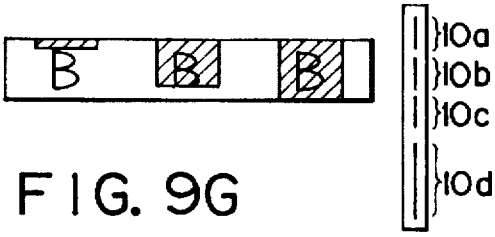
Figure 9G:
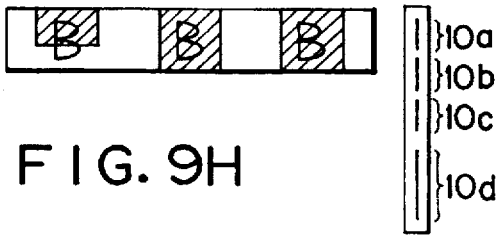
Figure 9H:
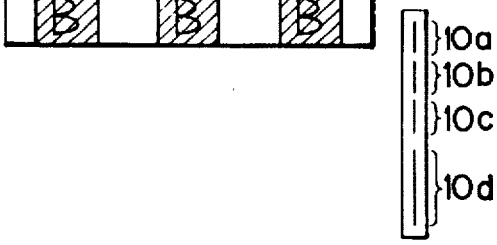

After the recording paper sheet is fed by another pitch, as shown in FIG. 9F, a portion of the remaining magenta background portion and a portion of a yellow background portion are printed using the magenta and yellow ink ejection nozzle groups 10*b* and 10*a*. After the recording paper sheet is fed by another pitch, as shown in FIG. 9G, the remaining portion of the magenta background portion and a portion of the remaining yellow background portion are printed. After the recording paper sheet is fed by another pitch, as shown in FIG. 9H, the remaining portion of the yellow background portion is printed.

When the image shown in FIG. 4 was printed by the above-mentioned method at an ink ejection frequency of 6 kHz, a high-quality image which suffered from less ink blurring than the first embodiment could be obtained.

(Third Embodiment)

In the first embodiment, the heat energy E2 to be applied to the 1th to 24th nozzles (24 nozzels) of the black ink ejection nozzle group 10*d*, and the heat energy E1 to be applied to the 25th to 48th nozzles (24 nozzles) are set to be different from each other by the following method.

Figure 6:
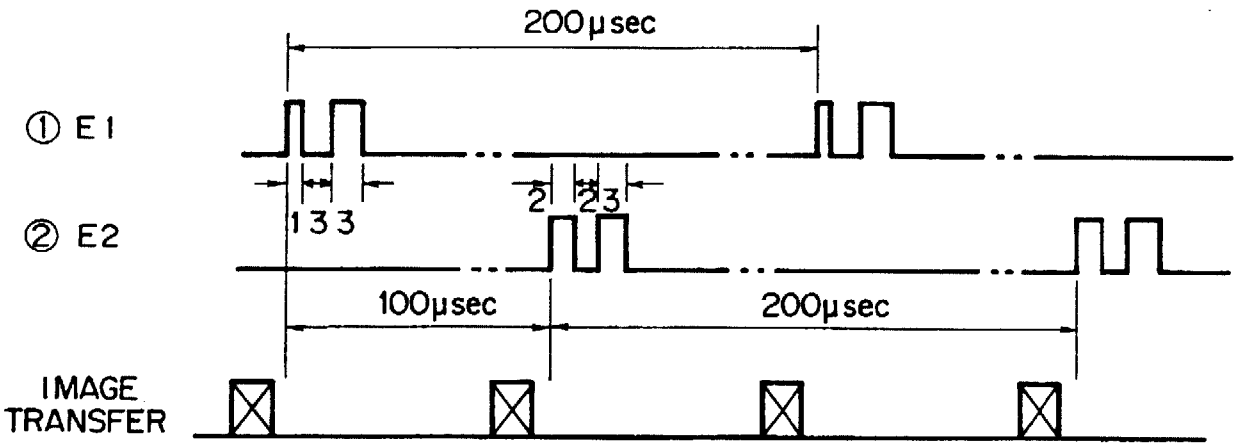
FIG. 6 is a chart for explaining heat energy to be applied to a recording head in the third embodiment.

As shown in FIG. 6, in this embodiment, the print frequency is set to be 5 kHz, and image data to be supplied to the recording head is transferred every 100 μsec. More specifically, image data of the adjacent portion to be printed by the 25th to 48th nozzles is transferred to the recording head, and is printed under the condition $\hat{1}$. Then, image data of the non-adjacent portion to be printed by the 1th to 24th nozzles is transferred to the recording head, and is printed under the condition $\hat{2}$. These operations are repeated every 200 μsec, so that different amounts of heat energy can be applied to the 1th to 24th nozzles, and to the 25th to 48th nozzles.

When the image shown in FIG. 4 was printed under the above-mentioned condition, a high-quality image free from ink blurring at the adjacent portion between the black and color image portions could be obtained.

(Comparative Example)

In the first to third embodiments, when the image shown in FIG. 4 was printed while both black dots adjacent to the color image and non-adjacent black dots are printed in a single scan with an equal amount of heat energy, ink blurring occurred particularly at a boundary portion between cyan and black in an image in which the black character was present on the cyan background portion.

Figure 13:
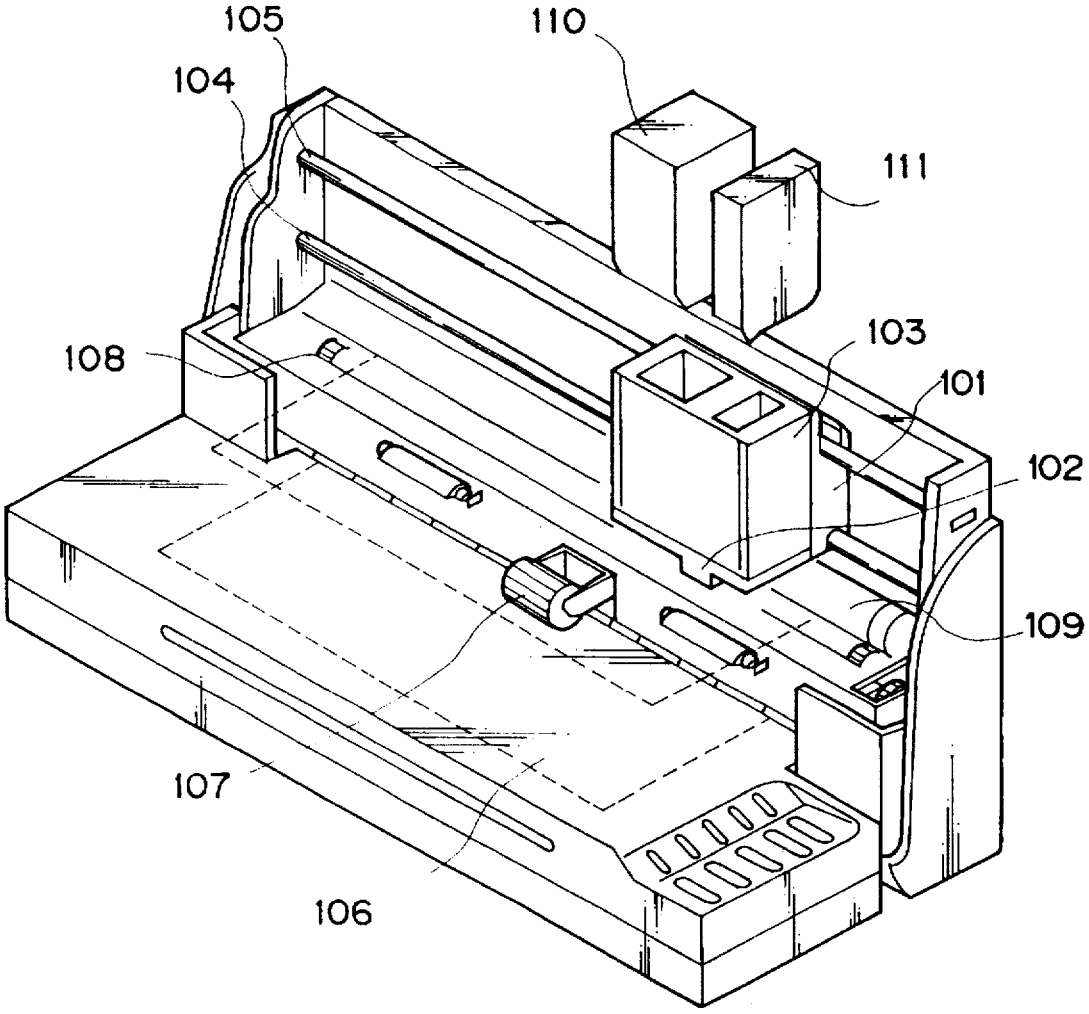
FIG. 13 is a perspective view of an ink jet recording apparatus to which the present invention can be applied.

FIG. 13 is a perspective view of an ink jet printer which carries an ink cartridge and a carriage and to which the present invention can be applied.

A carriage 101 carries a printing head 102 and a cartridge guide 103, and can be scanned along guide shafts 104 and 105. A recording paper sheet 106 is fed into the main body apparatus by a paper supply roller 107, is then fed to a position in front of a paper feed roller 108 while being clamped between the paper feed roller 108, a pinch roller (not shown), and a paper pressing plate 109, and is subjected to a printing operation. Two different ink cartridges, i.e., a color ink cartridge 110 which stores three color inks, i.e., yellow, magenta, and cyan inks, and a black ink cartridge 111 are prepared. These cartridges are independently inserted in the cartridge guide 103, and communicate with the printing head 102.

The yellow, magenta, and cyan inks stored in the color ink cartridge 110 have a high penetration speed to a recording paper sheet so as to prevent ink blurring at the boundaries of different colors upon formation of a color image. On the other hand, the black (Bk) ink stored in the black ink cartridge 111 has a relatively lower penetration speed to a recording paper sheet than that of the three color inks, so that a black image has a high density and high quality with less blurring of the ink.

The components of inks used in this embodiment are as follows.

| | |
|---|---|
| (Yellow) | |
| C.I. Direct Yellow 86 | 3 parts |
| diethylene glycol | 10 parts |
| isopropyl alcohol | 2 parts |
| urea | 5 parts |
| acetylenol EH (Kawaken Chemical) | 1 part |
| water | balance |
| (Magenta) | |
| C.I. Acid Red 289 | 3 parts |
| diethylene glycol | 10 parts |
| isopropyl alcohol | 2 parts |
| urea | 5 parts |
| acetylenol EH (Kawaken Chemical) | 1 part |
| water | balance |
| (Cyan) | |
| C.I. Direct Blue 199 | 3 parts |
| diethylene glycol | 10 parts |
| isopropyl alcohol | 2 parts |
| urea | 5 parts |
| acetylenol EH (Kawaken Chemical) | 1 part |
| water | balance |
| (Black) | |
| C.I. Direct Black 154 | 3 parts |
| diethylene glycol | 10 parts |
| isopropyl alcohol | 2 parts |
| urea | 5 parts |
| water | balance |

In this manner, the penetration properties of C, M, and Y inks are improved as compared to Bk by adding 1% of acetylenol EH thereto. Additives also include another surface-active agent, alcohol, and the like.

Figure 14A:
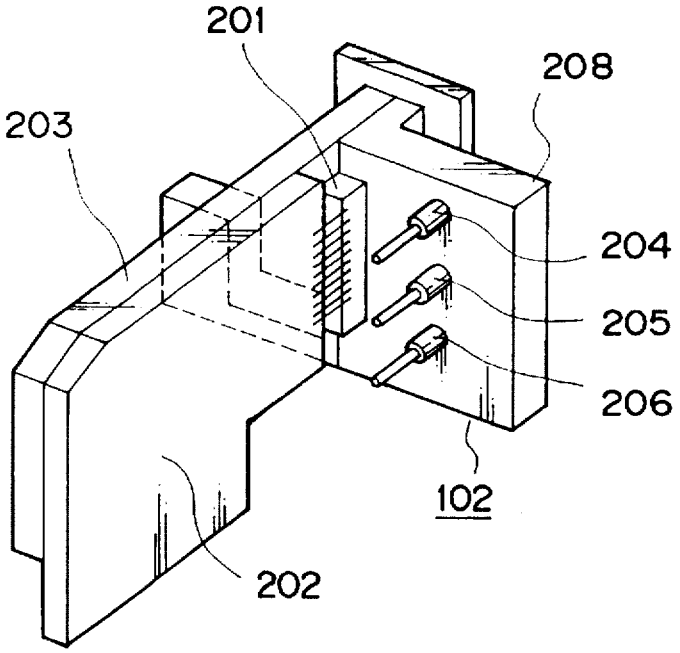
FIGS. 14A and 14B are perspective views of a head mechanism of the ink jet recording apparatus to which the present invention can be applied.
Figure 14B:
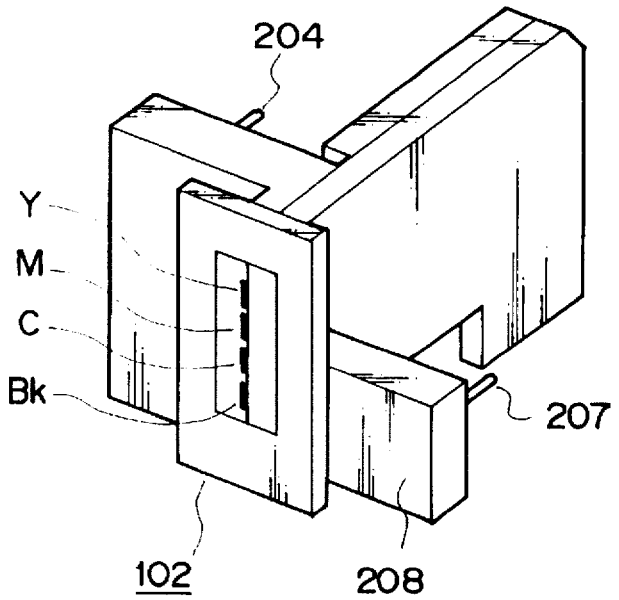

The printing head 102 will be described in detail below with reference to FIGS. 14A and 14B. Yellow, magenta, cyan, and black ejection nozzle (orifice) groups are linearly arranged on the front surface portion of the printing head 102. Each of the yellow, magenta, and cyan ejection nozzle groups has 24 ejection nozzles, and the black ejection nozzle group has 64 ejection nozzles. The interval between the two adjacent color ejection nozzle groups corresponds to 8 nozzles, and the interval between the black and color ejection nozzle groups corresponds to 16 nozzles. These nozzles are arranged at a density of 360 nozzles per inch (360 dpi). Normally, when only a black image is printed, all the 64 ejection nozzles of the black ejection nozzle group are used, and when a color image including a black image is printed, 24 ejection nozzles of each of the yellow, magenta, cyan, and black ejection nozzle groups are used.

These ejection nozzles respectively have ink channels communicating with the corresponding ejection nozzles, and a common ink chamber for supplying an ink to these ink channels is arranged behind a portion where the ink channels are formed. In the ink channels corresponding to the ejection nozzles, electro-thermal energy converting members for generating heat energy utilized to eject ink droplets from these ejection nozzles, and electrode wiring patterns for supplying electric power to these converting members are arranged. The electro-thermal energy converting members and the electrode wiring patterns are formed on a substrate 201 (consisting of, e.g., silicon) by a film formation technique. The ejection nozzles, the ink channels, and the common ink chamber are defined by stacking partition walls, a top plate, and the like, which consist of a resin or a glass material, on the substrate. A drive circuit for driving the electro-thermal energy converting members on the basis of a recording signal is arranged behind the common ink chamber in the form of a printed circuit board 202.

The silicon substrate 201 and the printed circuit board 202 project in a direction parallel to a single aluminum plate 203, and pipes 204 to 207 project from a plastic member 208 called a distributor which extends in a direction perpendicular to the silicon substrate. These pipes communicate with ink flow paths in the distributor, and the flow paths communicate with the common ink chamber.

The four ink flow paths for yellow, magenta, cyan, and black are formed in the distributor, and couple the common ink chamber to the corresponding pipes.

The yellow, magenta, and cyan ejection nozzles formed on the printing head 102 each eject about 40 ng of ink, and the black (Bk) ejection nozzles eject about 80 ng of ink.

Figure 15:
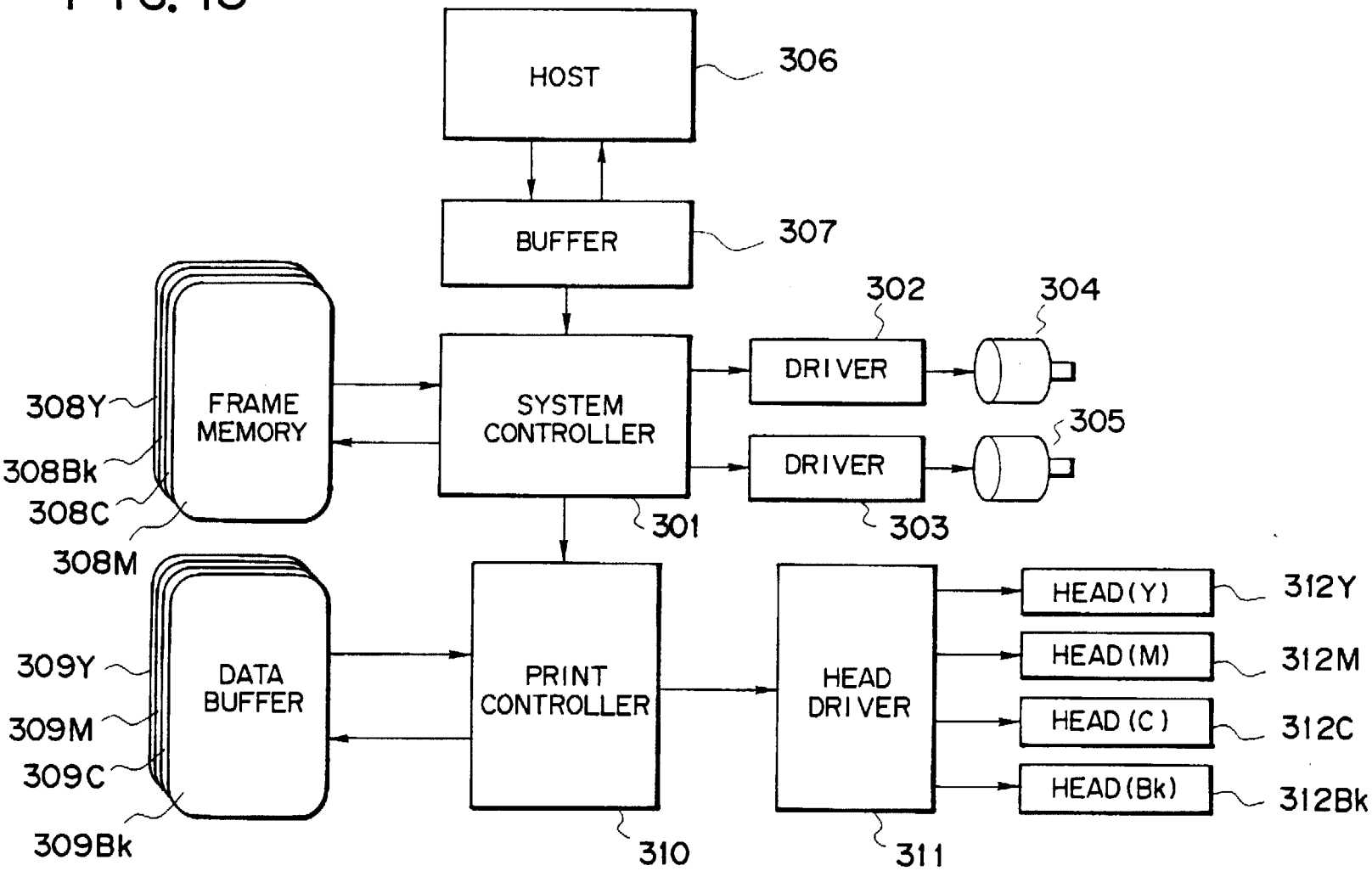
FIG. 15 is a block diagram of a control circuit of the ink jet recording apparatus to which the present invention can be applied.

FIG. 15 is an electrical control block diagram of the above-mentioned color ink jet printer.

A system controller 301 controls the entire printer, and includes a microprocessor, a memory element (ROM) storing a control program, another memory element (RAM) used by the microprocessor upon execution of processing, and the like. A driver 302 drives the printing head in the main scanning direction, and a driver 303 similarly drives the printing head in the sub-scanning direction. Motors 304 and 305 respectively correspond to the drivers 302 and 303, and operate upon reception of information such as speeds, moving distances, and the like from the drivers.

A host computer 306 transfers information to be printed to the printer of the present invention. A reception buffer 307 temporarily stores data from the host computer 306 until the stored data are read out by the system controller 301. Frame memories 308Y, 308M, 308C, and 308Bk are used for developing data to be printed into image data, and each frame memory has a memory size required for printing. In this embodiment, each frame memory can store data for one print paper sheet. However, the present invention is not limited to this.

Data buffers 309Y, 309M, 309C, and 309Bk 20 temporarily store data to be printed, and their storage capacities are determined in correspondence with the numbers of nozzles of corresponding printing head portions. A print controller 310 properly controls the printing head in accordance with commands from the system controller. For example, the controller 310 controls the ejection speed, the number of print data, and the like of the printing head. A driver 311 drives head portions 312Y, 312M, 312C, and 312Bk, and is controlled by signals from the print controller 310.

As described above, according to the recording method of the present invention, since dots adjacent to a color image portion and non-adjacent dots in a black image portion adjacent to the color image portion are controlled to be printed in different scans, no blurring at the boundary between a black image and a color image occurs, thus obtaining a high-quality recorded image. Since no blurring at the boundary between a black image and a color image occurs, the ejection amount of the black ink can be set to be larger than that of the color inks. As a result, a high-quality image with a high density can be obtained. Furthermore, these effects can be attained without prolonging the print time for one page.

(Fourth Embodiment)

In a recording method according to the fourth embodiment of the present invention, in order to obtain an image in which black and color images are formed adjacent to each other, as shown in FIG. 4 above, using the recording head shown in FIG. 1, a cyan image is divisionally printed in forward and backward scans of the recording head, as will be described below with reference to (a) to (g) of FIG. 16.

Figure 16:
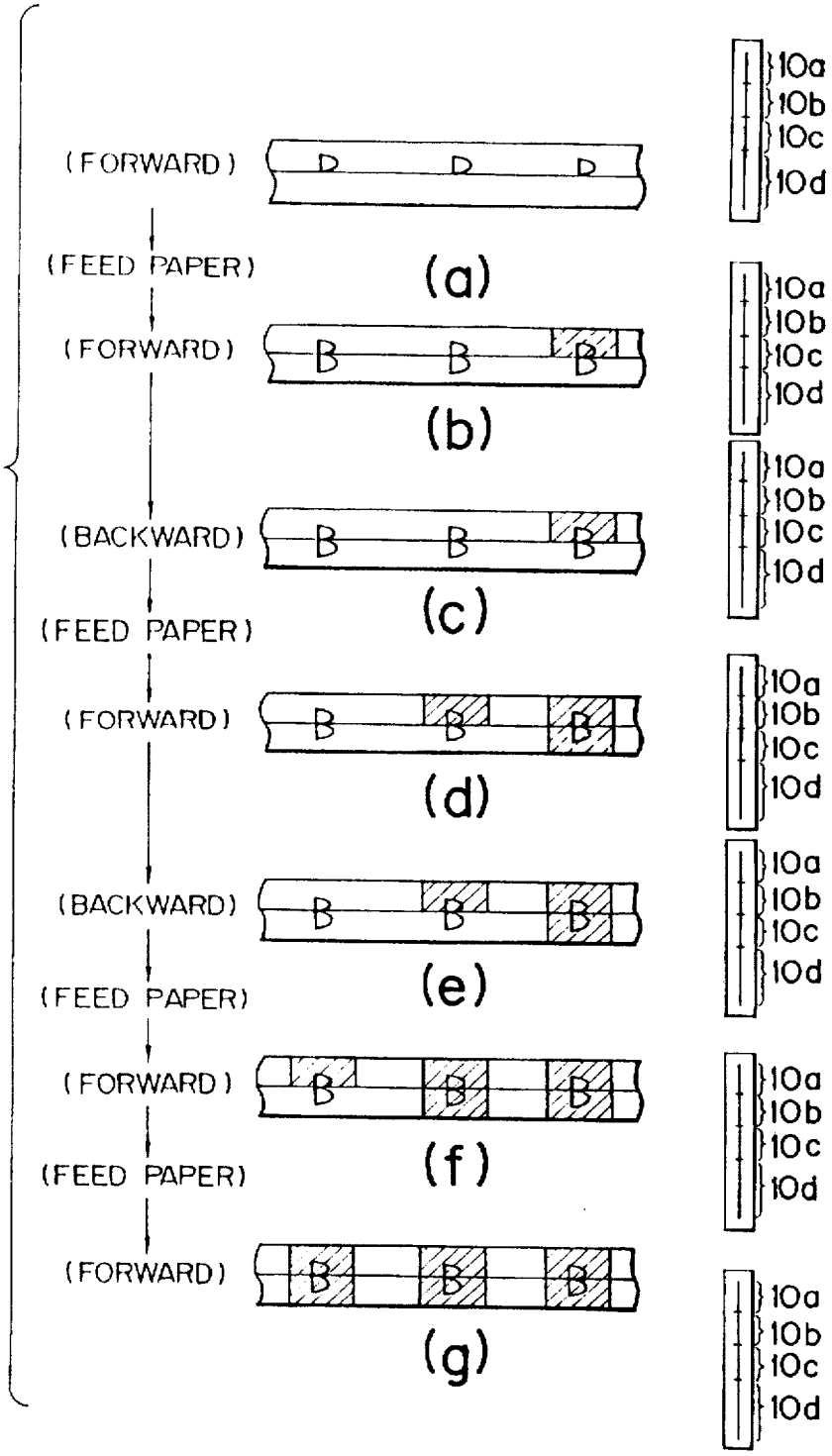
FIG. 16 is a view for explaining a process for printing an image, in which a black image portion and a color image portion are formed adjacent to each other, by a method of the fourth embodiment.

As shown in (a) of FIG. 16, the upper half dots of black characters "B" are printed using the upper half nozzles of the black ink ejection nozzle group **10*d*** in the forward scan of the recording head. Subsequently, the backward scan of the recording head is performed to feed a recording paper sheet by a 24-nozzel pitch.

As shown in (b) of FIG. 16, the remaining lower half dots of the black characters "B" are printed using the upper half nozzles of the black ink ejection nozzle group **10*d*, and at the same time, dots, corresponding to a predetermined pattern, of the upper half dots of the background portion are printed in the forward scan using the cyan ink ejection nozzle group 10*c*. The predetermined pattern used in this case is, e.g., a pattern shown in FIG. 17A of checker patterns in units of unitary dots shown in FIGS. 17A and 17B. Furthermore, dots corresponding to the remaining pattern (FIG. 17B) are printed in the backward scan using the cyan ink ejection nozzle group 10*c*, as shown in (c) of FIG. 16**.

Figure 17A:
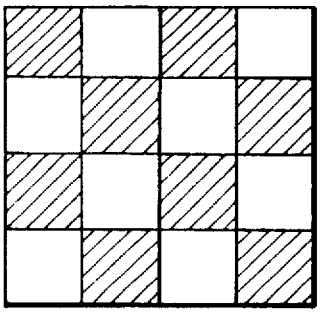
FIGS. 17A to 17D are views for explaining cyan ink patterns printed in forward and backward scans.

After the recording paper sheet is fed, as shown in (d) of FIG. 16, dots, corresponding to the pattern in FIG. 17A, of the lower half dots of the cyan background portion, and the upper half dots of a magenta background portion are printed respectively using the nozzle groups **10*c* and 10*b* in the forward scan. Furthermore, as shown in (e) of FIG. 16, dots, corresponding to the pattern in FIG. 17B, of the lower half dots of the cyan background portion are printed in the backward scan. The above-mentioned operations are repeated until the state shown in (g) of FIG. 16** is obtained, thus ending the print operation.

The image shown in FIG. 4 was printed in practice using the process described above with reference to (a) to (g) of FIG. 16. The ink ejection frequency common to the colors was set to be 6 kHz, and the divisional patterns for the forward and backward scans upon printing a cyan image adopted those shown in FIGS. 17A and 17B. As a result, a high-quality image which suffered from less ink blurring could be obtained.

Figure 17B:
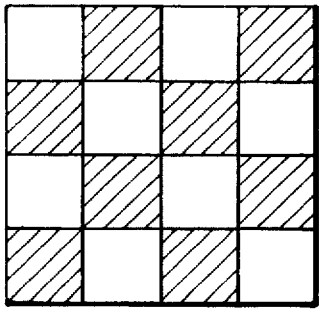
Figure 17C:
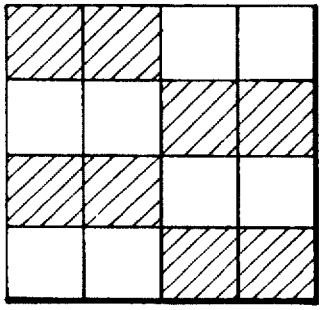
Figure 17D:
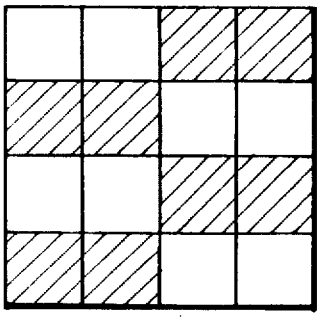

Note that the divisional patterns shown in FIGS. 17A and 17B are checker patterns in units of unitary dots. However, the present invention is not limited to these. For example, so-called staggered patterns or ladder patterns in units of two or four dots, as shown in FIGS. 17C and 17D, or randomly determined patterns may be used.

(Fifth Embodiment)

In the fourth embodiment, when a black image portion and a cyan image portion are to be printed adjacent to each other, in addition to divisionally printing the cyan image portion in the forward and backward scans of the recording head, the lower half 24 nozzles of the black ink ejection nozzle group 10*d* are used upon printing the black image, so that the scan of the recording head upon printing of the cyan image is not performed continuously with the scan of the recording head upon printing of the black image.

Figure 18:
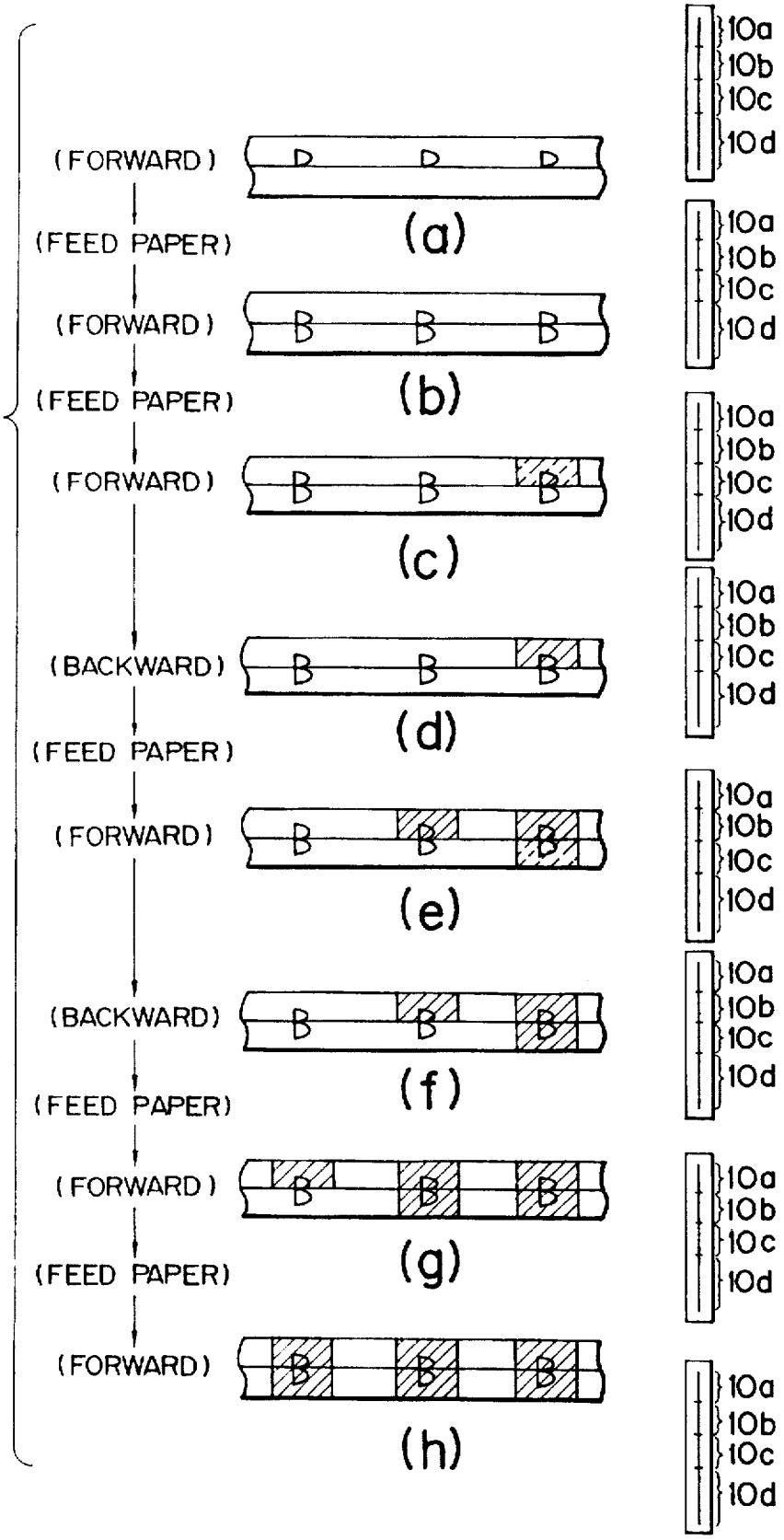
FIG. 18 is a view for explaining a process for printing the image shown in FIG. 4 by a method of the fifth embodiment.

More specifically, as shown in (a) of FIG. 18, the upper half dots of black characters "B" are printed using the lower half nozzles of the black ink ejection nozzle group 10*d*. Subsequently, after a recording paper sheet is fed by a 24-nozzel pitch, as shown in (b) of FIG. 18, the remaining lower half dots of the black characters "B" are printed using the lower half nozzles of the black ink ejection nozzle group 10*d*. After the recording paper sheet is fed by another 24-nozzel pitch, as shown in (c) of FIG. 18, dots, corresponding to the pattern shown in FIG. 17A, of the upper half dots of a cyan background portion are printed in the forward scan of the recording head using the cyan ink ejection nozzle group 10*c*. Subsequently, dots corresponding to the pattern shown in FIG. 17B are printed in the backward scan of the recording head, as shown in (d) of FIG. 18.

After the recording paper sheet is fed, as shown in (e) of FIG. 18, dots, corresponding to the pattern shown in FIG. 17A, of the lower half dots of the cyan background portion are printed in the forward scan of the recording head using the nozzle group 10*c*, and the upper half dots of a magenta background portion are printed. Subsequently, as shown in (f) of FIG. 18, dots, corresponding to the pattern shown in FIG. 17B, of the lower half dots of the cyan background portion are printed in the backward scan using the nozzle group 10*c*. After the recording paper sheet is fed, as shown in (g) of FIG. 18, the lower half dots of the magenta background portion are printed using the nozzle group 10*b*, and the upper half dots of a yellow background portion are printed using the nozzle group. 10*a*. After the recording paper sheet is fed, finally, the lower half dots of the yellow background portion are printed using the nozzle group 10*a*, as shown in (h) of FIG. 18.

According to the method of this embodiment, the scan of the black image can be performed not to be continuous with the scan of the color image while the number of times of scans of the recording head within one page is increased by only one as compared to the method of the fourth embodiment.

The image shown in FIG. 4 was printed in practice using the process described above with reference to (a) to (h) of FIG. 18. The ink ejection frequency common to the colors was set to be 6 kHz, and the divisional patterns for the forward and backward scans upon printing a cyan image adopted those shown in FIGS. 17A and 17B. As a result, the ink blurring prevention effect could be improved as compared to the fourth embodiment, and a high-quality image almost free from blurring could be obtained.

(Sixth Embodiment)

In the fourth embodiment, when a black image is printed, the black image is divided into two portions, one divided image portion is printed using the upper half ones of the 48 nozzles of the black ink ejection nozzle group 10*d*, and the other divided image portion is printed using the lower half ones of the 48 nozzles. The black image can be divided using the same patterns used for the forward and backward scans upon printing a cyan image. In this embodiment, the same patterns as those shown in FIGS. 17A and 17B are used.

This embodiment will be described below with reference to FIG. 19.

Figure 19:
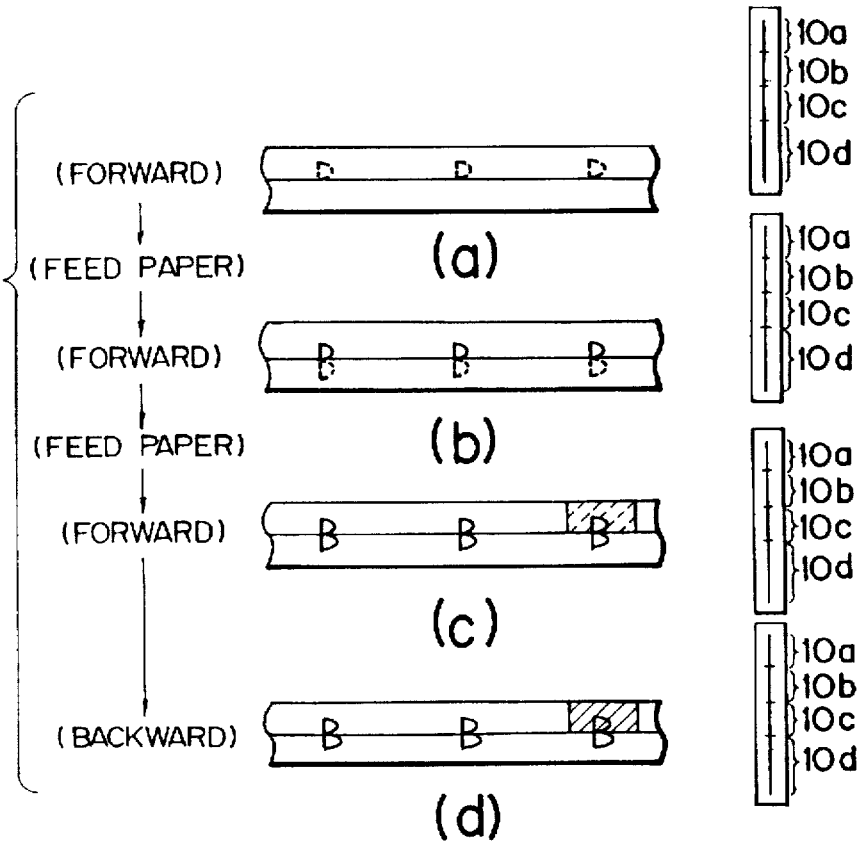
FIG. 19 is a view for explaining a process for printing the image shown in FIG. 4 by a method of the sixth embodiment.

As shown in (a) of FIG. 19, an image, corresponding to the pattern shown in FIG. 17A, of the upper half dots of a black image is printed using the lower half 24 nozzels of the black ink ejection nozzle group 10*d*. After a recording paper sheet is fed by a 24-dot pitch, as shown in (b) of FIG. 19, an image, corresponding to the pattern shown in FIG. 17B, of the upper half dots of the black image is printed using the upper half 24 nozzels of the black ink ejection nozzle group 10*d*, and an image, corresponding to the pattern shown in FIG. 17A, of the lower half dots of the black image is printed using the lower half 24 nozzels of the black ink ejection nozzle group 10*d*.

After the recording paper sheet is fed by another 24-nozzel pitch, as shown in (c) of FIG. 19, the print operation of a cyan background portion is started. In this case, since image formation after (c) of FIG. 19 is the same as that in the fourth and fifth embodiments, a detailed description thereof will be omitted.

In the method according to this embodiment, since black image formation is divisionally performed in two scans, the actual time until the black image contacts the cyan image is prolonged as compared to the fourth embodiment. Therefore, no ink blurring at the adjacent portion between the black and color image portions occurs while the number of times of scans of the recording head within one page is increased by only one as compared to the method of the fourth embodiment.

The image shown in FIG. 4 was printed in practice using the process described above with reference to FIG. 19. The ink ejection frequency common to the colors was set to be 6 kHz, and the divisional patterns for the forward and backward scans upon printing a cyan image adopted those shown in FIGS. 17A and 17B. As a result, the ink blurring prevention effect could be improved as compared to the fourth embodiment, and a high-quality image almost free from blurring could be obtained.

(Seventh Embodiment)

In this embodiment, a recording method for printing the image shown in FIG. 4 using the recording head shown in FIG. 10 above will be described below with reference to (a) to (g) of FIG. 20. As can be apparent from FIG. 20, when a black image is printed, upper nozzles for 24 dots (FIG. 20) of the black ink ejection nozzle group 10*d* are used.

Figure 20:
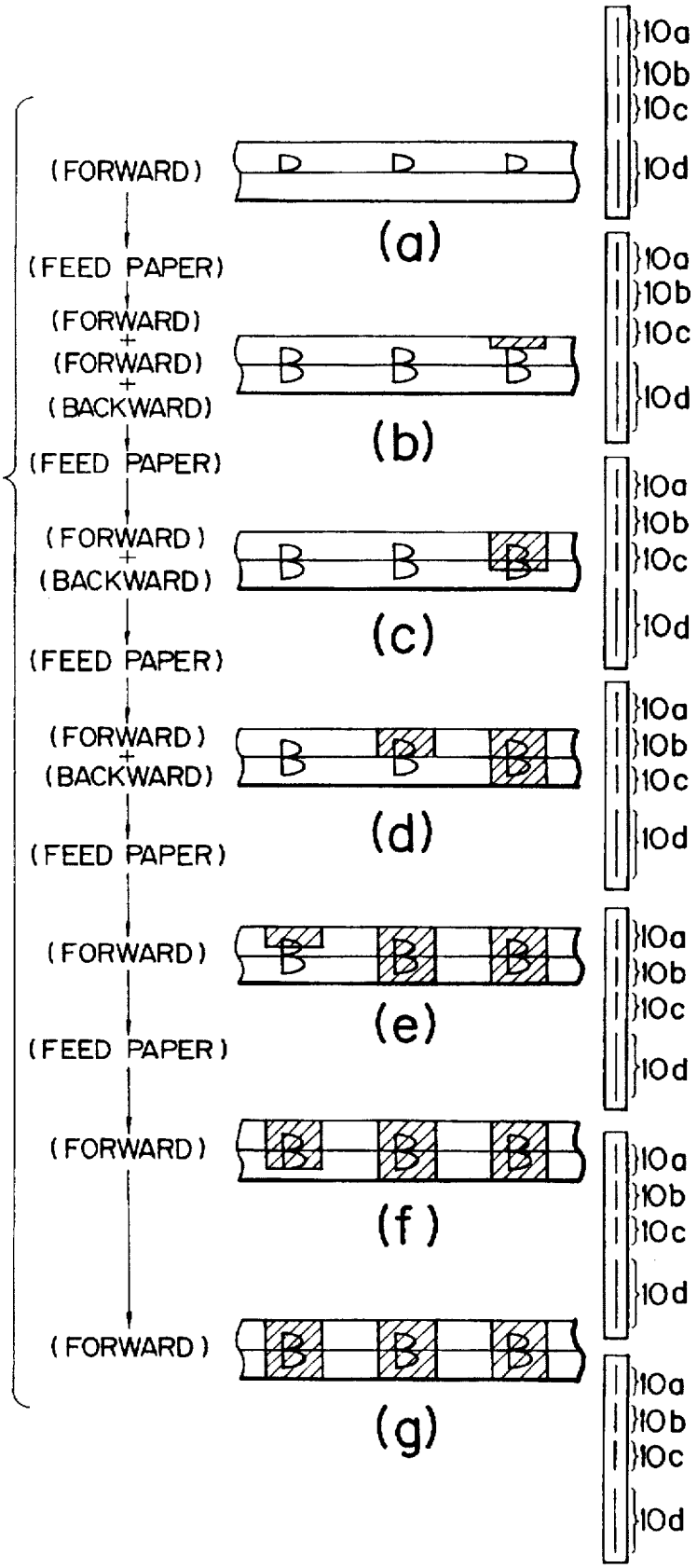
FIG. 20 is a view for explaining a process for printing the image shown in FIG. 4 by a method of the seventh embodiment.

As shown in (a) of FIG. 20, the upper half dots of black characters "B" are printed using the 1st to 24th nozzles. Subsequently, a recording paper sheet is fed by a 24-nozzel pitch, and the lower half dots of the black characters "B" are printed using the same nozzles, as shown in (b) of FIG. 20. At this time, the print operation of a color image is not performed. Then, in the forward scan of the recording head, a portion of a cyan background portion is printed using the cyan ink ejection nozzle group 10*c*. A pattern printed in this case is the pattern shown in FIG. 17A. Subsequently, in the backward scan, the pattern shown in FIG. 17B is printed. After the recording paper sheet is fed, as shown in (c) of FIG. 20, another image portion of the cyan background portion is printed in the forward and backward scans of the recording head. At this time, patterns printed in the forward and backward scans are those shown in FIGS. 17C and 17D.

After the recording paper sheet is fed, as shown in (d) of FIG. 20, the upper half portion of a magenta background portion and the remaining portion of the cyan background portion are printed. At this time, the magenta image is printed in only the forward scan of the recording head, and the cyan image is printed in both the forward and backward scans. Thereafter, the magenta and yellow background portions are printed in only the forward scan of the recording head.

In the seventh embodiment described above, the same effect as in the fourth embodiment can be obtained.

Furthermore, in the recording head used in the seventh embodiment, since the space for 16 nozzles is assigned between the black and cyan ink ejection nozzle groups, if the nozzles of the black ink ejection nozzle group used upon printing a black image are shifted by eight nozzles, and the 9th to 32nd nozzles (24 nozzeles) are used, this arrangement is equivalent to the fact that a space for 24 nozzels is assigned. Therefore, the same effect as in the fifth embodiment can be obtained as well.

In the fourth to seventh embodiments, only a cyan image is divisionally printed. However, magenta and yellow images may also be divisionally printed. If the bidirectional print operations of the respective colors are performed in the forward and backward scans of the recording head, high-precision registration control is required, resulting in an increase cost of the printer. When the bidirectional print operation is performed for only the cyan ink, print quality is not seriously influenced by registration control without executing high-precision control. Therefore, a low-cost, high-quality printer can be realized.

Note that the bidirectionally printed portions may be unidirectionally printed if an increase in the number of times of scans is allowed.

In each of the embodiments described above, in the print operation of a portion where black and color images are formed adjacent to each other, the color image adjacent to the black image is divisionally printed in two scans. Even when black and color images are formed independently, as shown in FIG. 3F, the same operations as described above may be performed.

As described above, according to the recording method of the present invention, since no blurring at a boundary portion between black and color images occurs, a high-quality recorded image can be obtained. Also, since no blurring at a boundary portion between black and color images occurs, the ejection amount of the black ink can be set to be larger than that of the color inks. As a result, a high-quality image including a high-density black image portion can be obtained. In addition, these effects can be attained without prolonging the print time for one page.

(Eighth Embodiment)

Figure 21B:
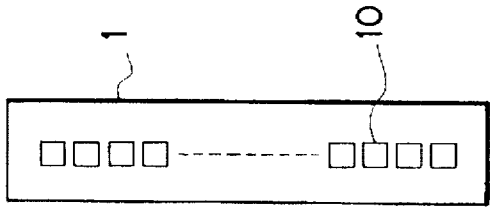
FIGS. 21A and 21B are schematic perspective views for explaining a printer and a recording head used in the eighth embodiment.
Figure 21A:
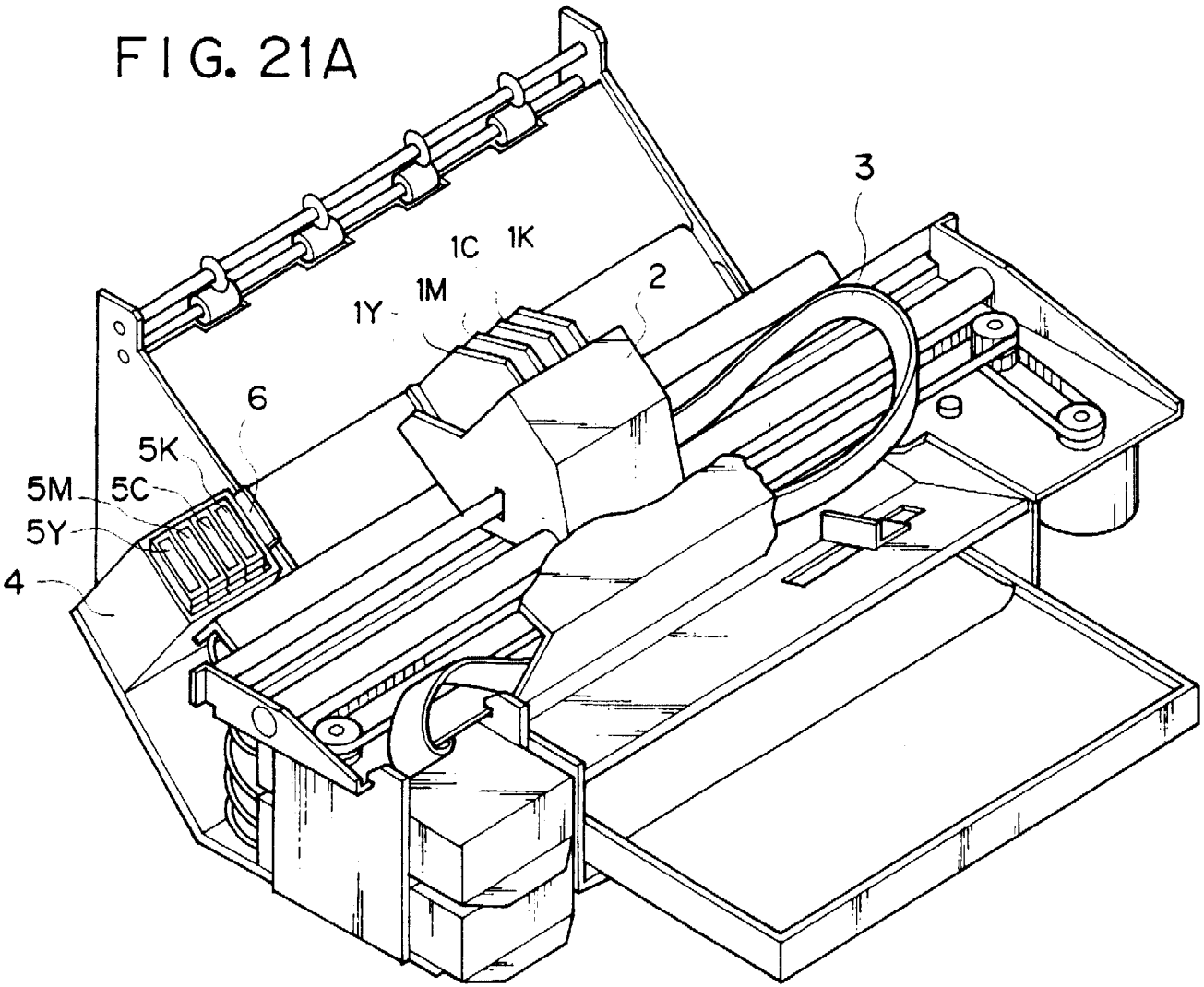

FIG. 21A is a perspective view showing a printer to which a color ink jet recording method is applied. The printer shown in FIG. 21A comprises a yellow ink recording head 1Y, a magenta ink recording head 1M, a cyan ink recording head 1C, a black ink recording head 1K, a carriage 2 which carries the recording heads, a flexible cable 3 for supplying electrical signals from a printer main body to the recording heads, a cap unit 4 having a recovery means, cap members 5Y, 5M, 5C, and 5K corresponding to the recording heads 1Y, 1M, 1C, and 1K, a wiper blade 6 consisting of a rubber member, and a recording paper sheet 7 which is held to oppose the recording heads.

FIG. 21B shows one of the four recording heads arranged in the printer. Sixty-four ejection nozzles 10 are formed on a portion, opposing a recording paper sheet, of the recording head at a density of 360 nozzles per inch (360 dpi). An ink channel communicates with each of these ejection nozzles 10, and a common ink chamber for supplying inks to the ink channels is arranged behind a portion where the ink channels are formed. Electro-thermal converting elements for generating heat energy utilized to eject ink droplets from the ejection nozzles, and electrode wiring patterns for supplying electric power to the converting elements are arranged in the ink channels corresponding to the ejection nozzles.

The ejection nozzles of the recording heads 1Y, 1M, and 1C each eject about 40 ng of ink, and the ejection nozzles of the recording head 1K eject about 80 ng of ink at a frequency of 6.3 kHz.

The color inks to be supplied to the recording heads 1Y, 1M, and 1C have a high penetration speed to a recording paper sheet so as to prevent ink blurring at the boundaries of different colors upon formation of a color image. On the other hand, the black ink to be supplied to the recording head 1K has a relatively lower penetration speed to a recording paper sheet than that of the three color inks, so that a black image has a high density and high quality free from feathering. The ink components of these inks are the same as those in the above embodiment.

This embodiment will be described below using the above-mentioned printer with reference to FIGS. 22A to 22G. In an image shown in FIG. 22A, a portion where a black character "b" is present in a yellow background portion, and a portion where a black character "B" is solely present are juxtaposed.

Figure 22A:
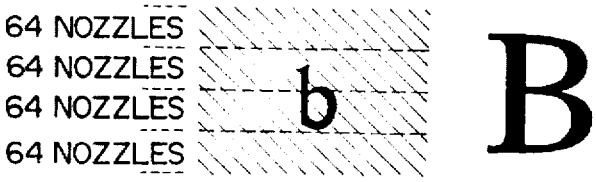
FIGS. 22A to 22G are views for explaining a print process in the eighth embodiment.
Figure 22B:
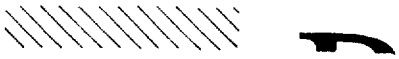

As shown in FIG. 22B, a portion of the yellow background and a portion of the black character "B" in the upper portion of the image shown in FIG. 22A are printed by the scan of the recording head 1, and a recording paper sheet is fed by a 64-nozzle pitch.

Figure 22C:
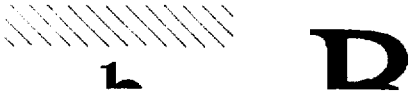

Subsequently, as shown in FIG. 22C, the upper half portion of the black character "b" and another portion of the character "B" are printed by the second scan of the recording head 1. At this time, the yellow background portion is not printed. Also, the recording paper sheet is not fed.

Figure 22D:
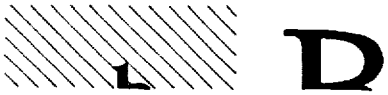

As shown in FIG. 22D, the yellow background portion is printed by the third scan of the recording head 1, and the recording paper sheet is fed by another 64-nozzle pitch.

Figure 22E:
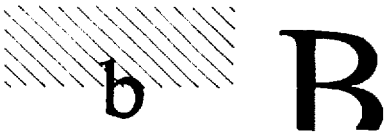

As shown in FIG. 22E, the lower half portion of the black character "b" and still another portion of the character "B" are printed by the fourth scan of the recording head 1. At this time, the yellow background portion is not printed. Also, the recording paper sheet is not fed.

Figure 22F:
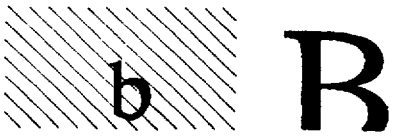

Subsequently, as shown in FIG. 22F, the yellow background portion is printed by the fifth scan of the recording head 1, and the recording paper sheet is fed by another 64-nozzle pitch.

Figure 22G:
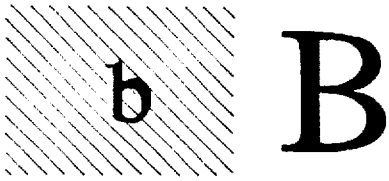

Finally, as shown in FIG. 22G, the yellow background portion and the remaining portion of the black character "B" are printed by the sixth scan of the recording head 1, thus ending formation of the image shown in FIG. 22A.

As described above, according to this embodiment, when black and color images are present adjacent to each other, since the black image of the adjacent l boundary portion and the color image are formed in different scans, a high-quality image free from ink blurring of the adjacent boundary portions can be obtained.

In this embodiment, the black character "B" is formed in the same scan as the black character "b". However, since the character "B" is not adjacent to the yellow image, it may be printed in the same scans as those for forming the yellow image, i.e., in the scans shown in FIGS. 22D and 22F.

(Ninth Embodiment)

In this embodiment, when black and color image portions are present adjacent to each other, the adjacent boundary portions of these image portions are formed in a plurality of scans using the printer and the recording head used in the eighth embodiment.

Figure 23A:
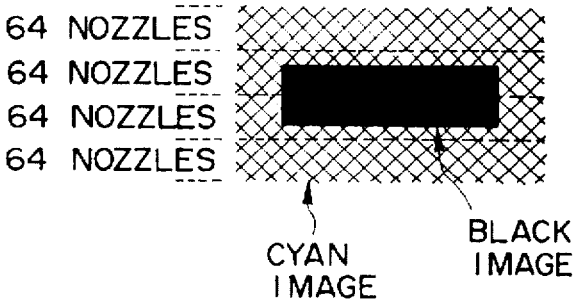
FIGS. 23A to 23G are views for explaining a print process in the ninth embodiment.

A process for forming an image in which black and cyan images are present adjacent to each other, as shown in FIG. 23A, will be described below.

Figure 23B:
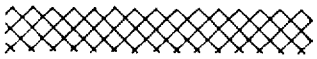

As shown in FIG. 23B, a portion of a cyan image is printed by the recording head 1, and a recording paper sheet is fed by a 64-nozzle pitch.

Figure 23C:
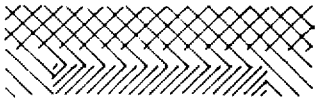
Figure 24A:
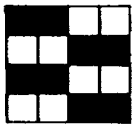
FIGS. 24A and 24B are views for explaining patterns used for executing a print operation in two scans in the ninth embodiment.
Figure 24B:
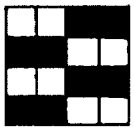

Subsequently, as shown in FIG. 23C, another portion of the cyan image, and a portion of a black image are printed, and the recording paper sheet is not fed. At this time, these image portions are printed not in a single scan but in two scans according to patterns shown in FIGS. 24A and 24B. In this case, in the black image portion, only pixels corresponding to the pattern shown in FIG. 24A are printed, and in the cyan image portion, only pixels corresponding to the pattern shown in FIG. 24B are printed.

Figure 23D:
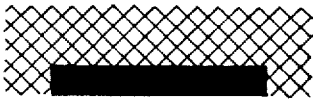

As shown in FIG. 23D, the remaining portions of the black and cyan image portions printed in FIG. 23C are printed, and the recording paper sheet is fed by another 64-nozzle pitch. In this case, in the black image portion, only pixels corresponding to the pattern shown in FIG. 24B are printed, and in the cyan image portion, only pixels corresponding to the pattern shown in FIG. 24A are printed.

With the scans shown in FIGS. 23C and 23D, the print operation of the upper adjacent portion between the black and color images is completed.

Figure 23E:
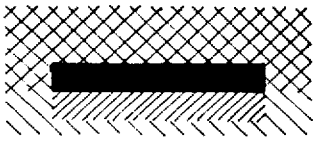
Figure 23F:
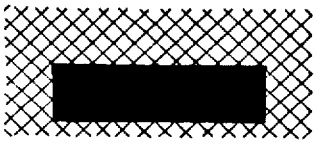

Scans shown in FIGS. 23E and 23F are performed in the same manner as in FIGS. 23C and 23D, thus completing the print operation of the lower adjacent boundary portions of the black and color image portions.

Figure 23G:
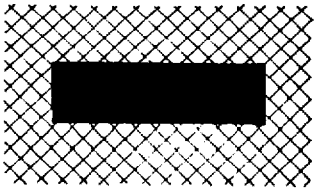

After the recording paper sheet is fed by another 64-nozzle pitch, as shown in FIG. 23G, the remaining portion of the cyan image is finally printed, thus ending all the image formation scans.

As described above, according to the method of this embodiment, since the adjacent boundary portions of the black and color images are divisionally formed in two scans so that dots forming the black image are not formed directly adjacent to dots forming the color image, a high-quality image can be obtained without causing ink blurring at the adjacent boundary portions.

(10th Embodiment)

In this embodiment, the ejection amount of the inks to be printed on the adjacent boundary portions of black and color images is set to be smaller than that of the inks to be printed on the non-adjacent boundary portions using the printer and the recording head used in the eighth embodiment.

FIGS. 25A to 25F are views for explaining a process for printing the same image as that shown in FIG. 23A.

Figure 25A:
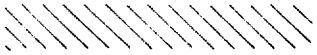
FIGS. 25A to 25F are views for explaining a print process in the 10th embodiment.

Referring to FIG. 25A, a portion of the cyan image is printed, and a recording paper sheet is fed by a 64-nozzle pitch. The ejection amount of the cyan ink at this time is about 40 ng, as has been described in the eighth embodiment.

Figure 25B:
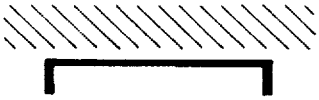

As shown in FIG. 25B, only the adjacent boundary portions of the black and cyan images are printed. At this time, the recording paper sheet is not fed. In this case, the ejection amounts of the black and cyan inks are independently controlled to be about 70 ng and 35 ng, respectively.

Figure 26A:
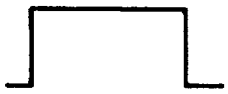
FIGS. 26A and 26B are charts for explaining a print pulse to be applied to a recording head in the 10th embodiment.
Figure 26B:
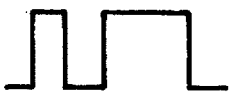

More specifically, the ink ejection amount can be changed by changing the pulse waveform to be applied to electrothermal energy converting members (heaters) of the recording head. For example, when a pulse to be supplied for a single ejection is defined by a single continuous pulse (single pulse), as shown in FIG. 26A, or is defined by divided pulses (double pulses), as shown in FIG. 26B, the latter pulse can provide a larger ejection amount. In this embodiment, in order to obtain about 80 ng of the black ink and about 40 ng of the color inks as the normal ejection amounts for printing the non-adjacent boundary portions, the double pulses shown in FIG. 26B are used. As for the pulse widths, the width of the first pulse (pre-pulse) is 1 μsec, the interval from the end of the first pulse to the beginning of the second pulse is 3 μsec, and the width of the second pulse (main pulse) is 3.5 μsec. In order to obtain about 70 ng of the black ink and about 35 ng of the cyan ink as the ejection amounts for printing the adjacent boundary portions, the single pulse shown in FIG. 26A is used, and is set to have a pulse width of 4.5 μsec.

Figure 25C:
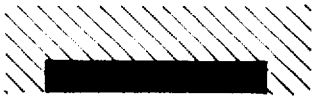

As shown in FIG. 25C, the non-adjacent boundary portions of the black and cyan images are printed, and the recording paper sheet is fed by another 64-nozzle pitch. At this time, the ejection amount of the black ink is about 80 ng, and the ejection amount of the cyan ink is about 40 ng.

Figure 25D:
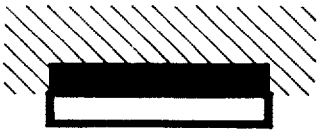
Figure 25E:
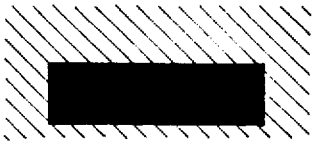
Figure 25F:
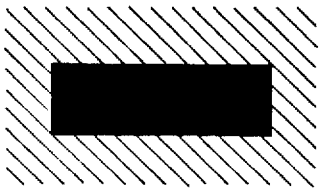

Thereafter, as shown in FIGS. 25D and 25E, the adjacent boundary portions of the black and cyan images are similarly printed, and finally, the cyan image is printed, as shown in FIG. 25F, thus completing all the image formation scans.

As described above, according to this embodiment, since the ejection amount of the inks at the adjacent boundary portions of the black and color images is set to be smaller than the ejection amount at the non-adjacent boundary portions, ink blurring at the adjacent boundary portions of the black and color images can be suppressed, and a high-quality image can be obtained.

In the ninth embodiment, the print operation is performed in two scans according to the patterns shown in FIGS. 24A and 24B. However, the present invention is not limited to the patterns shown in FIGS. 24A and 24B. For example, the patterns can be freely set like a combination of the patterns shown in FIGS. 27A and 27B, a combination of the patterns shown in FIGS. 27C and 27D, and the like. In the ninth embodiment, the adjacent boundary portions are printed in two scans. However, the number of times of scans can be three or more. For example, the print operation may be performed in four scans of the recording head using four different patterns shown in FIGS. 28A to 28D. When the number of times of scans is increased, ink blurring at the adjacent boundary portions of the black and color images can be further suppressed, and an image with higher quality can be obtained.

In the 10th embodiment, when the adjacent boundary portions of the black and color images are printed, the ejection amounts of both the black and color inks are decreased. However, one of the black and color inks may be decreased in correspondence with the characteristics of the inks to be used or the ink ejection frequency. Furthermore, in the 10th embodiment, the ink ejection amounts for one pixel of the adjacent boundary portions of the black and color images are decreased. However, the ejection amounts for a plurality of pixels (e.g., two pixels in FIG. 29) of the adjacent boundary portions may be decreased in correspondence with the characteristics of the inks to be used or the ink ejection frequency.

As described above, according to the recording method of each of the above embodiments, since no blurring at the adjacent boundary portions of black and color images occurs, a high-quality recorded image can be obtained. Also, since no blurring at the adjacent boundary portions of black and color images occurs, the ejection amount of the black ink can be set to be larger than that of the color inks. As a result, a high-quality image including a high-density black image portion can be obtained.

(11th Embodiment)

Figure 30:
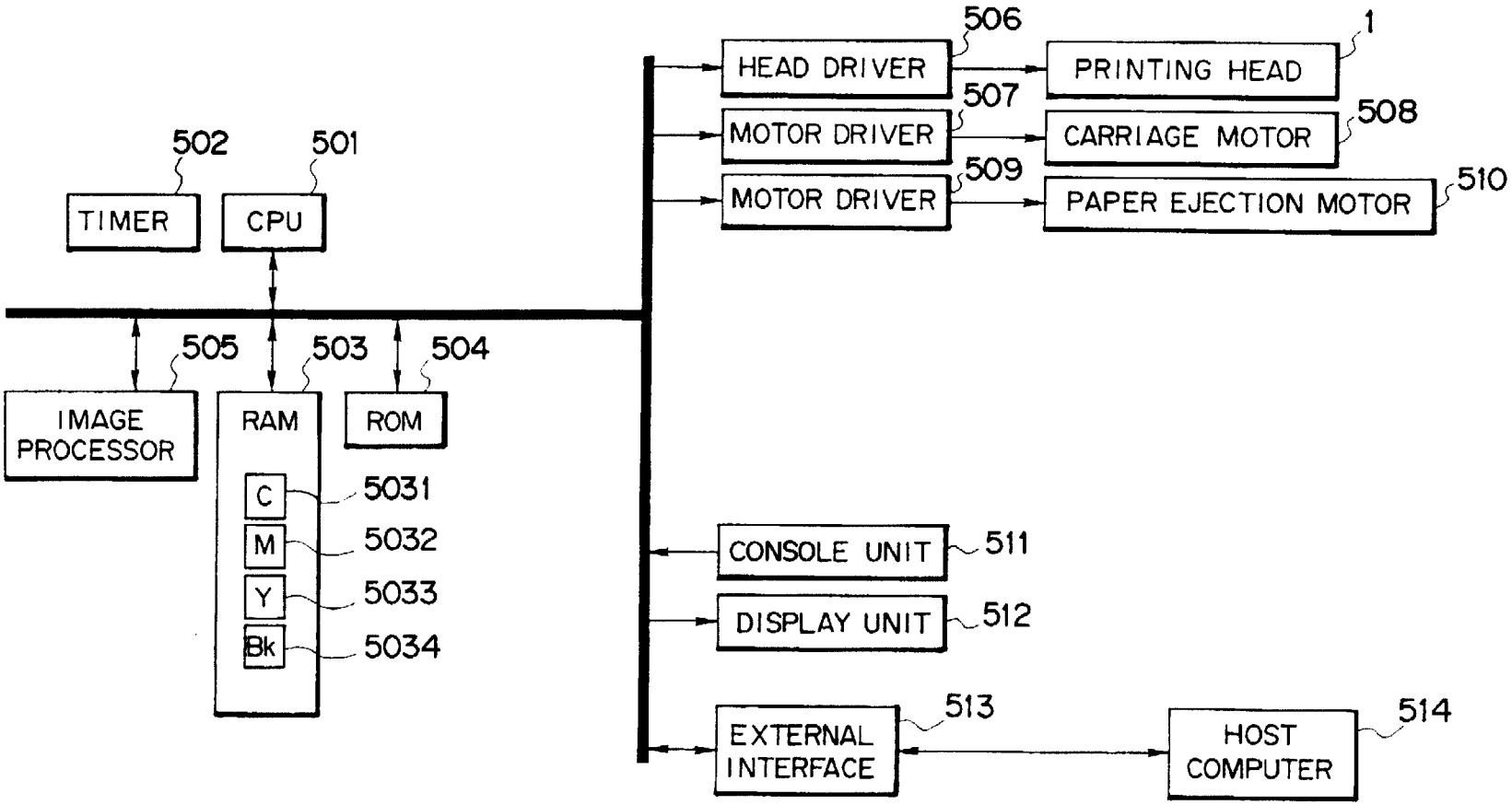
FIG. 30 is a block diagram of an electrical circuit of an ink jet recording apparatus according to the present invention.

FIG. 30 is a block diagram of an electrical circuit of a color ink jet recording apparatus according to the present invention. A CPU 501 controls the entire color ink jet recording apparatus, and includes a circuit for independently executing macro processing such as data transfer processing. A timer 502 generates timing signals required in the control of the CPU 501, and system clocks for the entire logic circuit portion.

Print data supplied from a host computer 514 is input to an external interface unit 513 comprising hardware, and is then sent onto a bus line. The data is temporarily stored in a buffering area of a RAM 503 under the control of the CPU 501. The CPU 501 develops the stored data into image data in cooperation with an image processor 505 in accordance with a program stored in a ROM 504. When the data is a character code, image data corresponding to this character code is read out from the ROM 504, and is stored in an image buffer area of the RAM 503. Alternatively, image data corresponding to this character code is generated by a logic circuit. At this time, when image data is color data, cyan, magenta, yellow, and black data of the image data are respectively stored in cyan, magenta, yellow, and black image buffer areas 5031, 5032, 5033, and 5034 of the RAM 503. The above-mentioned image data are sent to a head driver 506 by a data transfer control circuit included in the CPU 501, and are printed by a printing (recording) head 1. The head driver 506 includes an electric power-element for driving the printing head 1. Also, the driver 506 comprises independent head driving circuits for yellow, cyan, magenta, and black head portions. These circuits receive image data of the corresponding colors. A console unit 511 serves as a man-machine interface for a font designation operation, an on-line/off-line operation, a line feed operation, and the like, and the CPU 501 displays a response corresponding to the operation to the console unit 511 on a display unit 512. Motor drivers 507 and 509 are controlled by the CPU 501, and respectively drive a carriage motor 508 and a paper ejection motor 510.

Figure 31:
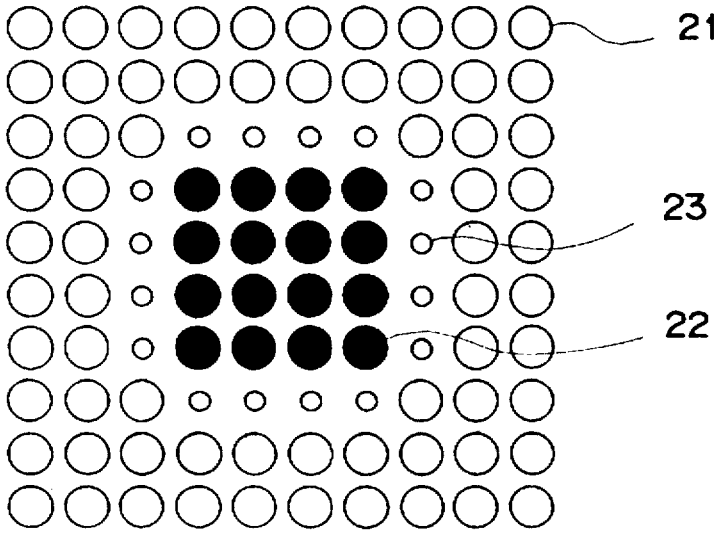
FIG. 31 is a view showing an example of an image recorded according to the 11th embodiment.

FIG. 31 shows an example of an image recorded according to this embodiment. FIG. 31 illustrates an image consisting of 10×10 pixels. Background color record pixels 21 have Y color, and main image record pixels 22 expressing a square image in K color are present inside the pixels 21. Therefore, in this case, only two colors of inks Y and K are used in practice, and a color boundary defined by a color difference of images corresponds to the boundary between the main image record pixels 22 expressing the square in K color, and the background color record pixels 21 in Y color.

In this example, the ink ejection amount for only background color record small pixels 23 as the background color of the boundary portion is decreased to about 90% of the normal amount. Thus, blurring at a boundary portion between the background color and the main image can be eliminated, and satisfactory recording can be attained.

The ejection amount is decreased by controlling the width of the driving pulses to be applied to heat generating members of the recording head. More specifically, the heat generating members are normally driven by applying 10-μsec pulses, while they are driven by applying 8.5-μsec pulses for the background color of the boundary.

Figure 32:
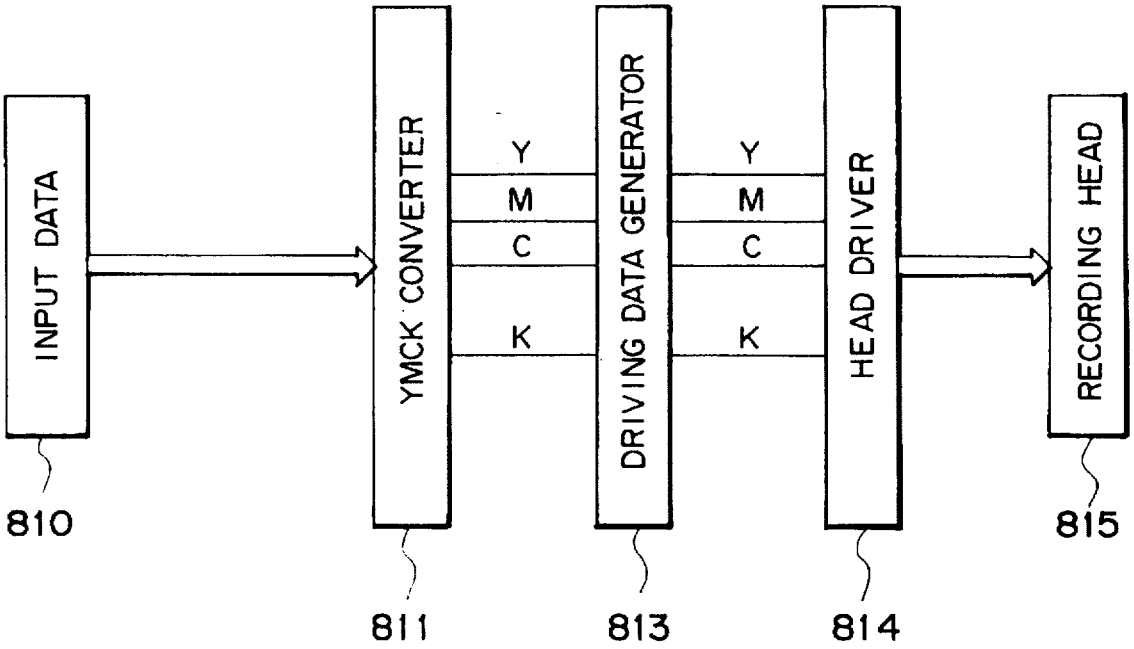
FIG. 32 is a block diagram of a recording apparatus of the 11th embodiment.

FIG. 32 is a block diagram of the recording apparatus for executing this embodiment. Input data (R, G, and B) 810 such as a character or image to be recorded are input to a YMCK converter 811. The converter 811 converts R, G, and B color data into four Y, M, C, and K color data. A driving data generator 813 selects the driving pulse width by discriminating whether or not ink ejection is performed for each of pixels corresponding to the Y, M, C, and K colors, and whether or not the pixel corresponds to a boundary portion. These discrimination operations are performed for upper, lower, right, and left pixels of a record pixel of interest on a recording medium. In the discrimination operations, data for the upper, lower, right, and left pixels on the recording medium are calculated for the pixel of interest by a memory unit in the driving data generator 813. If a boundary portion is determined, the shorter pulse width than the normal pulse width is selected for only colors other than K color. These data are input to a head driver 814, and a recording head 815 selectively ejects ink droplets.

Therefore, according to this embodiment, the ejection amount of one color pixel other than K color is decreased at a boundary portion between K color and another color. Also, the ejection amount of one pixel for each of two colors is decreased at a boundary portion between two different colors other than K color.

Figure 33:
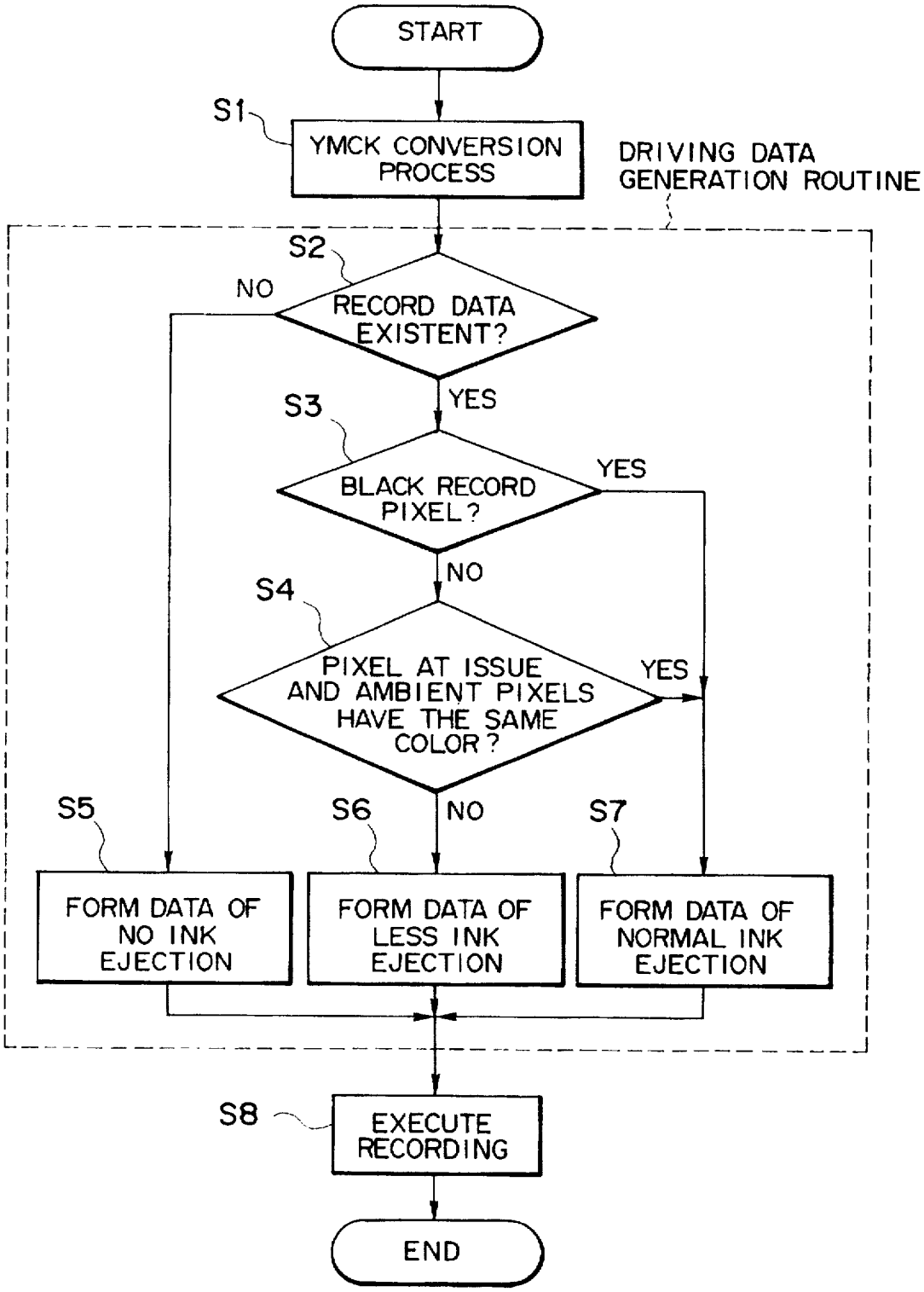
FIG. 33 is a flow chart showing an operation of the 11th embodiment.

FIG. 33 is a flow chart showing the operation of this embodiment. In step S1, input data is converted into data corresponding to Y, M, C, and K colors. Based on the data corresponding to these colors, driving data are generated in a driving data generation routine in steps S2 to S7 surrounded by a dotted frame in FIG. 33.

In the driving data generation routine, the presence/absence of record data is detected in step S2. If NO in step S2, the flow advances to step S5 to form data of no ink ejection, and the recording head is driven in step S8. If the presence of record data is detected in step S2, the flow advances to step S3 to check if the record data is a black record pixel. If YES in step S3, the flow advances to step S7 to form data of normal ink ejection. If it is determined in step S3 that the record data is data of a record pixel other than black, data of adjacent record pixels are checked in step S4. In this case, upper, lower, right, and left, adjacent data of the record pixel of interest are checked. If these adjacent pixels have the same color as the record pixel of interest, the flow advances to step S7 to form data of normal ink ejection. However, if data of a different color is detected, since the pixel of another color is formed adjacent to the record pixel of interest, the flow advances to step S6 to form driving data of less ink ejection. The recording head is driven according to the driving data generated in steps S5, S6, and S7, thus executing the recording operation.

With the above-mentioned arrangement, a recording error or a decrease in resolution caused by interference between ink droplets at a boundary portion between different color ink droplets can be prevented.

(12th Embodiment)

Figure 34:
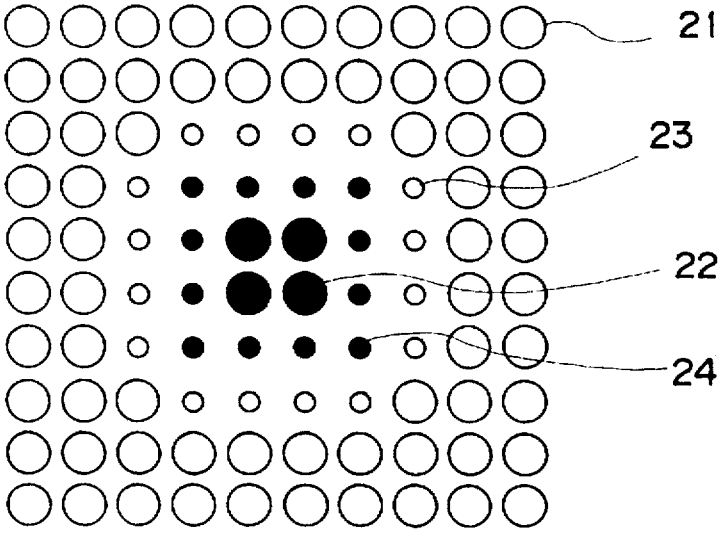
FIG. 34 is a view showing an image recorded according to the 12th embodiment.

In the 11th embodiment, as shown in FIG. 31, the ejection amount of only K color is not decreased even at a boundary portion. In contrast to this, in this embodiment, a boundary adjacent to another color is checked for all of C, M, Y, and K colors, and the ejection amounts of all colors at the boundary portion are decreased. FIG. 34 shows an image recorded by this method. The image shown in FIG. 34 consists of background color record pixels 21, background color record small pixels 23, main image record pixels 22, and main image record small pixels 24. In this case, decision of a black record pixel in step S3 in the flow chart shown in FIG. 33 can be omitted. When record pixels of K color and another color are formed adjacent to each other as in this embodiment, even when the ejection amounts of both the record pixels of K color and the other color are decreased, a recording error and a decrease in resolution at a boundary portion between record pixels can be prevented as in the 11th embodiment.

(13th Embodiment)

A method particularly effective for a case wherein one pixel is recorded using a plurality of color inks will be described below.

In the 11th embodiment, the number of background colors is only one (Y color only), and a square image formed by one color ink is illustrated in this background. However, the color ink jet printer does not always have all inks of colors to be output, and normally forms different colors by mixing a plurality of color inks or recording a plurality of color inks to overlap each other. In this embodiment, a remarkable effect is particularly obtained at a boundary when one pixel is recorded using a plurality of colors.

In the 11th embodiment, recording at a boundary portion between one color and another color is performed while decreasing the ejection amount of a pixel other than K color. In this embodiment, for example, when at least one of pixels at a color boundary portion is formed by two or more color inks as in a case wherein the background color is B (blue) color defined by two colors, i.e., C and Y, and a square is illustrated in K color in the background, recording can be performed while decreasing the ejection amount at only the color boundary portion.

When a color image is recorded using a plurality of color inks for one pixel, a recording error and a decrease in resolution caused by interference between inks at a boundary portion particularly easily occur. For this reason, in this embodiment, recording is performed while decreasing the ejection amount at only a color boundary portion of pixels at least one of which is formed by two or more colors.

This method is also effective when the ink absorption amount of a recording medium is not sufficient.

(14th Embodiment)

In the 11th embodiment, the background color is Y color, and a square image is illustrated in K color in the background. In particular, processing for decreasing the ejection amount of a color ink (CMY) other than K color without decreasing the ejection amount of K color even at a color boundary portion is effective for an image including relatively many K color portions, and an image including many regions on which K, RGB, or CMY images are illustrated without being divided into small pixel groups.

On the other hand, processing for decreasing the ejection amount of only K color for a boundary portion between K color and another color, and processing for decreasing the ejection amounts of both K color and another color (CMY) are effective for an image such as a natural image on which C, M, and Y colors are randomly present.

(15th Embodiment)

In the method of the 11th embodiment, upper, lower, right, and left boundary portions with respect to a pixel of interest on a recording medium are detected to decrease the ejection amount of the background color of an adjacent boundary pixel.

Alternatively, a method of detecting upper, lower, right, left, upper right, lower right, upper left, and lower left boundary portions with respect to a pixel of interest on a recording medium, and decreasing the ejection amount of the background color of an adjacent boundary pixel may be adopted. This method is effective for a case wherein the ink absorption amount of a recording medium is relatively small.

Figure 35:
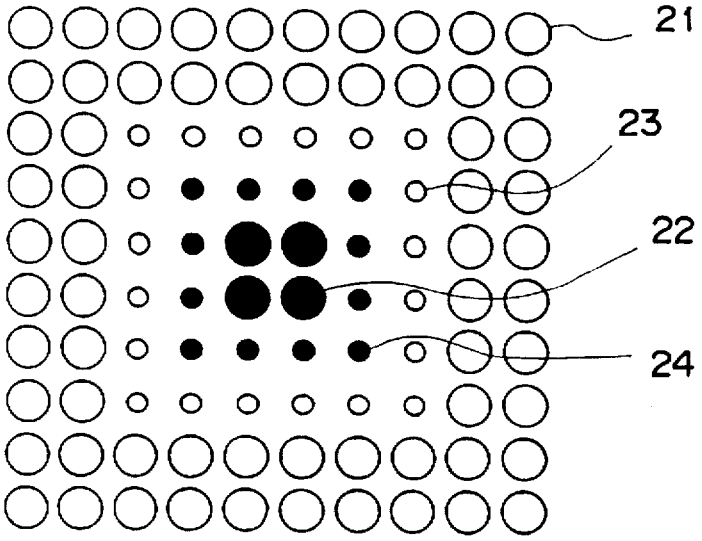
FIG. 35 is a view showing an image recorded according to the 15th embodiment.

FIG. 35 shows an image recorded by this method. In this case, the ejection amount of each main image record pixel 22 is also decreased. Note that reference numerals 21 to 24 denote the same pixels as in FIG. 34.

(16th Embodiment)

In the method of the 11th embodiment, upper, lower, right, and left boundary portions with respect to a pixel of interest on a recording medium are detected to decrease the ejection amount of the background color of only an adjacent boundary pixel.

Alternatively, a method of decreasing the ejection amount of the background color of two or more adjacent boundary pixels may be adopted. Furthermore, a method of detecting upper, lower, right, left, upper right, lower right, upper left, and lower left boundary portions with respect to a pixel of interest on a recording medium, and decreasing the ejection amount of the background color of two or more adjacent boundary pixels may be adopted. This method is effective for a case wherein the ink absorption amount of a recording medium is relatively small.

(17th Embodiment)

In the method of the 11th embodiment, in order to express gradation levels of the respective colors, a so-called area gradation method for changing the number of ink droplets to be ejected while the ejection amount as the amount of ink to be ejected is basically left unchanged is adopted.

On the other hand, even in a so-called analog gradation method for attaining gradation expression by changing the ejection amount in units of pixels, the method of the present invention is effective at the boundaries between different colors. In this case, processing for decreasing the ejection amount at a boundary to be 90% of that of a non-boundary pixel is executed. The ratio of a decrease in ejection amount is optimized in respective recording systems.

In each of the embodiments of the present invention, a normal paper sheet which is used in a large amount in, e.g., a copying apparatus is used as a recording medium. However, the recording method of the present invention is not limited to this. For example, the method of the present invention can be widely applied to various other recording media such as a cloth, an OHP (overhead projector) sheet, and the like.

In each of the 11th to 17th embodiments, in order to control the amount of ink droplets to be ejected from the ink jet recording head, a method of changing the width of pulses to be applied to the recording head is adopted. However, the present invention is not limited to this. For example, a method of changing the voltage value to be applied to the recording method, and/or a method of dividing a pulse to be applied to the recording head to eject one ink droplet into two pulses, and changing the pulse width of at least one of the divided pulses, or a method of changing the interval between two pulses may be adopted.

In each of the 11th to 17th embodiments, as an example of an ink jet recording apparatus to which the present invention can be applied, the printer shown in FIG. 18 is presented. In the recording head of the present invention, as shown in FIGS. 14A and 14B, nozzle groups for ejecting color inks are vertically aligned in line. However, the present invention is not limited to such a nozzle arrangement. For example, the nozzle groups may be horizontally arranged.

In each of the above embodiments, as the ink jet recording head, an ink jet recording head which utilizes heat energy, and ejects ink droplets by utilizing bubbles generated when heat generating members are selectively caused to generate heat in accordance with character or image information to be recorded is used.

On the other hand, as a method of ejecting an ink, a method using electromechanical energy converting elements is available. With this method, the same effect of the present invention can be obtained.

According to the present invention, conventional problems about image quality at a color boundary can be solved, and in particular, a recording error and a decrease in resolution caused by interference of inks at a boundary portion can be prevented.

In each of the above embodiments, image discrimination processing and image development processing are performed in the printer side on the basis of data received from the host computer. However, the present invention is not limited to this.

For example, the host computer may execute the image discrimination processing and image development processing on the basis of generated data, and may transmit these processed data to the printer. In this case, a processing load on the printer can be reduced.

Also, the image discrimination processing and image development processing may be respectively executed by the host computer and the printer.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the bubble, the liquid (ink) is ejected through an ejection outlet to produce at least one droplet. The driving signal is preferably in the form of a pulse, because the development and construction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 59-123670 wherein a common slit is used as the ejection outlet for plural electrothermal transducers, and to the structure disclosed in Japanese Laid-Open Patent Application No. 59-138461 wherein an opening for absorbing pressure wave of the thermal energy is formed corresponding to the ejection portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording head combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an addition heating element or a combination thereof. Also, means for effecting preliminary ejection (not for the recording operation) can stabilize the recording operation.

As regards the variation of the recording head mountable, it may be a single corresponding to a single color ink, or may be plural corresponding to the plurality of ink materials having different recording color or density. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal is supplied. The present invention is applicable to other types of ink. In one of them, the temperature rise due to the thermal energy is positively prevented by consuming it for the state change of the ink from the solid state to the liquid state. Another ink material which is solidified when it is left is used, to prevent the evaporation of the ink. In either of the cases, by the application of the recording signal producing thermal energy, the ink is liquefied and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 54-56847 and Japanese Laid-Open Patent Application No. 60-71260. The sheet is faced to the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

While the invention has been described with reference to the structures disclosed herein, it is not confined to the details set forth and this application is intended to cover such modifications or changes as may come within the purposes of the improvements or the scope of the following claims.

What is claimed is:

1. An ink jet recording method for obtaining a multi-color image by scanning, on a recording paper sheet, a recording head which has an ejection portion group including m ejection portions for ejecting a black ink and ejection portion groups each including n (2n<m) ejection portions for ejecting a color ink in accordance with a plurality of colors, and is arranged so that groups of ejection portions for ejecting the black and color inks do not overlap in a scan direction, comprising the steps of:

discriminating whether or not a black image to be printed using the black ink and a color image to be printed using the color inks are present adjacent to each other; and executing a scan for forming a black image portion adjacent to the color image independently of a scan for forming a black image portion which is not adjacent to the color image when it is determined that the black and color images are present adjacent to each other.

2. A method according to claim 1, wherein said m ejection portions for ejecting the black ink are divided into a first ejection portion group including first to i-th ejection portions, and a second ejection portion group including (i+1)-th to j-th (1<i<j≦m) ejection portions, the black image portion adjacent to the color image is printed using one of said first and said second ejection portion groups, and the black image portion which is not adjacent to the color image is printed using another of said first and said second ejection portion groups.

3. A method according to claim 2, wherein j=2i.

4. A method according to claim 1, wherein the color inks include yellow, magenta, and cyan inks.

5. A method according to claim 1, wherein said ejection portion group for ejecting the black ink is arranged at an end portion of said recording head.

6. A method according to claim 1, wherein a space is assigned between each two adjacent ejection portion groups of the respective colors.

7. A method according to claim 1, wherein the color inks are ejected by heat energy.

8. A method according to claim 1, wherein heat energy to be applied to print the black image portion adjacent to the color image is set to be different from heat energy to be applied to print the black image portion which is not adjacent to the color image so as to control an ejection amount of the ink.

9. An ink jet recording head comprising:

a plurality of nozzles for ejecting inks by forming bubbles upon reception of heat energy, at least some of said nozzles constituting a plurality of nozzle groups, each said nozzle group including m said nozzles for ejecting a black ink, and said nozzle group including n (2n≦m) nozzles for ejecting color inks in accordance with a plurality of colors, said recording head being arranged, so that said nozzle groups for ejecting the black and the color inks do not overlap each other, wherein said m nozzles for ejecting the black ink are divided into a first nozzle group including a first to an i-th nozzle, and a second nozzle group including an (i+1)-th to a j-th (1<i<j≦m) nozzle, so that one of the first nozzle group and the second nozzle group records a black image using the black ink adjacent to a color image to be recorded using the color inks and another of the first nozzle group and the second nozzle group records a black image not adjacent to the color image, and wherein different amounts of heat energy are supplied to said first and said second nozzle groups, so that a thermal energy applied to one of said first and said second nozzle groups is less than a thermal energy applied to another of said first and said second nozzle groups.

10. A head according to claim 9, wherein j=2i.

11. An ink jet recording method for obtaining a multi-color image by scanning, on a recording paper sheet, a recording head which has an ejection portion group including m ejection portions for ejecting a black ink and ejection portion groups each including n (2n≦m) ejection portions for ejecting a color ink in accordance with a plurality of colors, and is arranged so that groups of ejection portions for ejecting the black and color inks do not overlap in a scan direction, comprising the steps of:

discriminating whether or not a black image is present adjacent to a color image to be formed by an adjacent color ejection portion group for ejecting the color ink, the adjacent color election portion group being arranged adjacent to said ejection portion group for ejecting the black ink; and divisionally printing the image to be formed by the adjacent color ejection portion group in a plurality of scans when it is determined that the black image is present adjacent to the color image to be formed by the adjacent color ejection portion group.

12. A method according to claim 11, wherein when the color image is present adjacent to the black image, the black image is printed using predetermined ejection portions of said ejection portion group for ejecting the black ink, so that a scan for forming the black image and a scan for forming the color image are not continuously performed.

13. A method according to claim 11, wherein when he color image is present adjacent to the black image, the black image is divisionally printed in a plurality of scans.

14. A method according to claim 11, wherein the number of ejection portions used for printing the black image is 2n.

15. A method according to claim 11, wherein the color inks include yellow, magenta, and cyan inks.

16. A method according to claim 11, wherein said ejection portion group for ejecting the black ink is arranged at an end portion of said recording head.

17. A method according to claim 11, wherein a space is assigned between each two adjacent ejection portion groups of the respective colors.

18. A method according to claim 11, wherein a number l of predetermined ejection portions of said ejection portion group for ejecting the black ink satisfies l≦n.

19. A method according to claim 18, wherein a feed pitch of the recording paper sheet when the black image is present adjacent to the color image is associated with the number l of ejection portions.

20. A method according to claim 11, wherein the plurality of scans are performed in forward and backward paths.

21. A method according to any one of claims 11 to 20, wherein the inks are ejected by heat energy.

22. An ink jet recording method for forming a multi-color image by scanning, relative to a recording medium, a recording head, which has an ejection portion group for ejecting a black ink, and a plurality of ejection portion groups for ejecting a plurality of different color inks, comprising the steps of:

discriminating whether or not a black image to be formed by the black ink is present adjacent to a color image to be formed by the color ink; and performing image formation processing at an adjacent boundary portion between the black ink and the color ink so that said image formation processing at the adjacent boundary portion is different from image formation processing at a non-adjacent boundary portion when it is determined that the black image is present adjacent to the color image.

23. A method according to claim 22, wherein when the color image is present adjacent to the black image, the black and color images are formed in different scans.

24. A method according to claim 22, wherein when the color image is present adjacent to the black image, at least one of a black image of the adjacent boundary portion and the color image is divisionally formed in a plurality of scans.

25. A method according to claim 22, wherein when the color image is present adjacent to the black image, an ink ejection amount for forming at least one of a black image of the adjacent boundary portion and the color image is decreased.

26. A method according to claim 22, wherein the plurality of color inks include yellow, magneta, and cyan inks.

27. An ink jet recording method, having a recording head provided with a large number of ejection portions associated with a plurality of color inks, for recording an image ink a recording medium by ejecting the plurality of color inks in accordance with image information, comprising the step of:

recording record pixels located in a predetermined region along a color boundary defined by a color difference in units of record pixels of the image in an ejection amount smaller than an ejection amount for a portion which is not the color boundary.

28. A method according to claim 27, wherein when the record pixel located in the predetermined region along the color boundary has a predetermined color, the ejection amount of a recording ink droplet for forming the record pixel is set to be a normal ejection amount.

29. A method according to claim 27, wherein the predetermined region along the color boundary is associated with one pixel adjacent to the color boundary.

30. A method according to claim 27, wherein the predetermined region along the color boundary is associated with a region of two or more pixels adjacent to the color boundary.

31. An ink jet recording method, having an ink jet recording head provided with a large number of ejection portions associated with a plurality of color inks, for recording an image on a recording medium by ejecting the plurality of color inks in accordance with image information such that ejection amounts are variable, the method comprising the steps of:

converting input image data into data in accordance with the plurality of colors;

detecting a presence/absence of record data from the data in accordance with the colors;

discriminating in a color discrimination step if the record data detected in the data detecting step is record data of a predetermined color;

discriminating in an adjacent data discrimination step if the record data of a color other than the predetermined color discriminated in the color discrimination step is record data of the same color as the color of record data of adjacent record pixels;

generating in a driving data generating step driving data for setting an ejection amount of the record data in accordance with the detection and discrimination results in the data detection step, the color discrimination step, and the adjacent data discrimination step; and executing recording by driving said ink jet recording head in accordance with the driving data.

32. A method according to claim 31, wherein the predetermined color discriminated in the color discrimination step is black.

33. A method according to claim 31, wherein the driving data generating step includes the steps of:

generating driving data for ejecting no ink when no record data is detected in the data detection step;

generating driving data which does not change an ejection amount of the ink when it is determined in the color discrimination step that the record data is record data of the predetermined color; and setting an ejection amount of the ink to be smaller than a normal ejection amount when it is determined in the adjacent data discrimination step that the record data of interest is not record data of the same color as the color of the adjacent record data.

34. An ink jet recording method, having an ink jet recording head provided with a large number of ejection portions associated with a plurality of color inks, for recording an image on a recording medium by variably ejecting the plurality of color inks in accordance with image information, the method comprising the steps of:

converting input image data into data in accordance with the plurality of colors;

detecting a presence/absence of record data from the data in accordance with the colors;

discriminating if the record data detected in the data detection step is record data of the same color as the color of record data of adjacent record pixels;

generating driving data for setting an ejection amount of the record data in accordance with the detection and discrimination results in the data detection step and the adjacent data discrimination step; and executing recording by driving said ink jet recording head in accordance with the driving data.

35. A method according to claim 31, wherein the driving data generating step includes the steps of:

generating driving data for ejecting no ink when no record data is detected in the data detection step; and setting an ejection amount of the ink to be smaller than a normal ejection amount when it is determined in the adjacent data discrimination step that the record data of interest is not record data of the same color as the color of the adjacent record data.

36. A method according to any one of claims 31 to 35, wherein the adjacent data discrimination step includes the step of performing discrimination for upper, lower, right, and left adjacent record data of the record data.

37. A method according to any one of claims 31 to 35, wherein the adjacent data discrimination step includes the step of performing discrimination for upper, lower, right, left, upper-right, lower right, upper left, and lower left adjacent record data of the record data.

38. An ink jet recording method, having an ink jet recording head provided with a large number of ejection portions associated with a plurality of color inks, for recording an image on a recording medium by ejecting the plurality of color inks in accordance with image information, comprising the step of:

recording record pixels, which are formed by two or more inks, of record pixels located in a predetermined region along a color boundary defined by a color difference in units of record pixels of the image, in a smaller ejection amount of the inks for forming the record pixels than an ejection amount for a portion which is not the color boundary.

39. An ink jet recording method, having an ink jet recording head provided with a large number of ejection portions associated with a plurality of color inks, for recording an image on a recording medium by ejecting the plurality of color inks in accordance with image information, comprising the step of:

recording record pixels located in a predetermined region along a color boundary defined by a color difference in units of record pixels of the image, in an ejection amount smaller than an ejection amount for a portion which is not the color boundary when at least one of record pixels of different colors adjacent to the color boundary is formed by two or more inks.

40. A method according to claims 38 or 39, wherein the plurality of color inks includes cyan, magenta, yellow, and black inks.

41. A method according to any one of claims 27–35, 38 or 39, wherein said ink jet recording head comprises heat energy generating means for causing a change in state in the ink by heat, and forming flying ink droplets by ejecting the ink from the ejection portions in accordance with the change in state.

42. A method according to claim 40, wherein said ink jet recording head comprises heat energy generating means for causing a change in state in the ink by heat, and forming flying ink droplets by ejecting the ink from the ejection portions in accordance with the change in state.

43. An ink jet recording apparatus for obtaining a multicolor image on a recording paper sheet, comprising:

a recording head having an ejection portion group including m ejection portions for ejecting a black ink and a plurality of ejection portion groups each including n ($2n \leqq m$) ejection portions for ejecting a color ink in accordance with a plurality of colors, said recording head being constructed so that said groups of said ejection portions for ejecting the black and the color inks do not overlap in a scan direction;

scanning means for scanning said recording head relative to said recording paper sheet in the scan direction;

discriminating means for discriminating if a black image to be printed using the black ink and a color image to be printed using the color inks are present adjacent to each other; and scan executing means for executing a scan for forming a black image portion adjacent to the color image independently of a scan for forming a black image portion which is not adjacent to the color image when it is determined that the black and the color images are present adjacent to each other.

44. An ink jet recording apparatus for obtaining a multicolor image on a recording paper sheet, comprising:

a recording head having an ejection portion group including m ejection portions for ejecting a black ink and a plurality of ejection portion groups each including n ($2n \leqq m$) ejection portions for ejecting a color ink in accordance with a plurality of colors, said recording head being constructed so that said groups of said ejection portions for ejecting the black and the color inks do not overlap in a scan direction;

scanning means for scanning said recording head relative to said recording paper sheet in the scan direction;

discriminating means for discriminating if a black image is present adjacent to a color image to be formed by an adjacent color ejection portion group for ejecting the color ink, the adjacent color ejection portion group being arranged adjacent to said ejection portion group for ejecting the black ink; and divisional print means for divisionally printing the image to be formed by the adjacent color ejection portion group in a plurality of scans when said discriminating means discriminates that the black image is present adjacent to the color image to be formed by the adjacent color ejection portion group.

45. An ink jet recording apparatus for recording a multicolor image on a recording sheet, comprising:

a recording head having an ejection portion group for ejecting a black ink, and a plurality of ejection portion groups for ejecting a plurality of different color inks, scanning means for scanning said recording head relative to said recording medium in a scan direction;

discriminating means for discriminating if a black image to be formed by the black ink is present adjacent to a color image to be formed by the color ink; and image processing means for performing an image formation processing at an adjacent boundary portion between the black ink and the color ink so that the image formation processing at the adjacent boundary portion is different from an other image formation processing at a non-adjacent boundary portion when said discriminating means discriminates that the black image is present adjacent to the color image.

46. An ink jet recording apparatus for recording an image on a recording medium, comprising:

a recording head having a plurality of ejection portions associated with a plurality of color inks, for recording the image on the recording medium by ejecting the color inks in accordance with an input image information;

image recording means for recording a plurality of record pixels in a predetermined region along a color boundary defined by a color difference in units of record pixels of the image by causing said recording head to eject the ink in an ejection amount which is smaller than an ejection amount of the ink for a portion which is not the color boundary.

47. An ink jet recording apparatus for recording an image on a recording medium in accordance with an input image data, comprising:

an ink jet recording head having a plurality of ejection portions associated with a plurality of color inks, an ejection amount of the inks being variable;

converting means for converting the input image data into a data in accordance with the colors;

data detecting means for detecting if a record data is present from the data in accordance with the colors to obtain a detection result;

color discriminating means for discriminating if the record data detected by the data detecting means is data of a predetermined color to obtain a first discrimination result;

adjacent data discriminating means for discriminating if the record data is data of a color other than the predetermined color discriminated by the color discriminating means and that record data is of the same color as the color of record data of adjacent record pixels to obtain a second discrimination result;

driving data generating means for generating a driving data for setting the ejection amount of the record data in accordance with the detection result, the first discrimination result, and the second discrimination result of the data detecting means, the color discriminating means, and the adjacent data discriminating means; and executing means for executing recording by driving said ink jet recording head in accordance with the driving data generated by the driving data generating means.

48. An ink jet recording apparatus for recording an image on a recording medium in accordance with an input image information, comprising:

an ink jet recording head having a plurality of ejection portions associated with a plurality of color inks;

converting means for converting the input image data into a data in accordance with the colors;

data detecting means for detecting if a record data is present from the data in accordance with the colors to obtain a detection result;

adjacent data discriminating means for discriminating if the record data detected by the data detecting means is data of a same color as a color of the record data of adjacent record pixels to obtain a discrimination result;

driving data generating means for generating a driving data for setting an ejection amount of the record data in accordance with the detection result and the discrimination result of the data detecting means and the adjacent data discriminating means; and recording executing means for executing recording by driving said ink jet recording head in accordance with the driving data generated by the driving data generating means.

49. An ink jet recording apparatus for recording an image on a recording medium, by ejecting a plurality of color inks in accordance with an image information, comprising:

an ink jet recording head having a plurality of ejection portions associated with the plurality of color inks, image recording means for recording a plurality of record pixels, which are formed by at least two said inks, the record pixels being located in a predetermined region along a color boundary defined by a color difference in units of record pixels of the image, in a smaller ejection amount of the inks for forming the record pixels than an ejection amount for a region which is not the color boundary.

50. An ink jet recording apparatus for recording an image on a recording medium, comprising:

an ink jet recording head having a plurality of ejection portions associated with a plurality of color inks, for recording the image on the recording medium by ejecting the color inks in accordance with an input image information;

image recording means for recording a plurality of record pixels in a predetermined region along a color boundary defined by a color difference in units of record pixels of the image, by causing said recording head to eject the ink in an ejection amount which is smaller than an ejection amount of the ink for a region which is not the color boundary when at least one of record pixels of different colors adjacent to the color boundary is formed by at least two said inks.

* * * * *

UNITED STATES PATENT AND TRADEMARK OFFICE

CERTIFICATE OF CORRECTION

PATENT NO. : 5,748,207

DATED : May 5, 1998

INVENTOR(S) : TOSHIHARU INUE ET AL.

It is certified that error appears in the above-identified patent and that said Letters Patent is hereby corrected as shown below:

On title page, item

[56] REFERENCES CITED

Foreign Patent Documents
"1114447" should read --1-114447--.
"3132256" should read --3-132256--.
"3146355" should read --3-146355--.
"4158049" should read --4-158049--.

COLUMN 1

Line 37, "$\hat{1}$" should read --①--, and

"$\hat{2}$" should read --②--.

COLUMN 8

Line 44, "$\hat{1}$" should read --①--.

Line 48, "$\hat{2}$" should read --②--.

Line 52, "$\hat{2}$" should read --②--.

Line 55, "$\hat{1}$" should read --①--.

UNITED STATES PATENT AND TRADEMARK OFFICE

CERTIFICATE OF CORRECTION

PATENT NO. : 5,748,207

DATED : May 5, 1998

INVENTOR(S) : TOSHIHARU INUE ET AL.

It is certified that error appears in the above-identified patent and that said Letters Patent is hereby corrected as shown below:

COLUMN 9

Line 13, "$\hat{1}$" should read --①--.

Line 16, "$\hat{1}$" should read --①--.

Line 19, "$\hat{2}$" should read --②--.

Line 24, "$\hat{2}$" should read --②--.

Line 59, "$\hat{1}$" should read --①--.

Line 62, "$\hat{2}$" should read --②--.

COLUMN 14

Line 60, "24-nozzel" should read --24-nozzle--.

COLUMN 16

Line 64, "1" should be deleted.

COLUMN 25

Line 15, "(2n<m)" should read --(2n≤m)--.

UNITED STATES PATENT AND TRADEMARK OFFICE

CERTIFICATE OF CORRECTION

PATENT NO. : 5,748,207

DATED : May 5, 1998

INVENTOR(S) : TOSHIHARU INUE ET AL.

It is certified that error appears in the above-identified patent and that said Letters Patent is hereby corrected as shown below:

COLUMN 26

Line 42, "he" should read --the--.

COLUMN 27

Line 28, "magneta" should read --magenta--.
Line 31, "ink" should read --on--.

Signed and Sealed this

First Day of December, 1998

*Attest:*

*Attesting Officer*

BRUCE LEHMAN

*Commissioner of Patents and Trademarks*